US007909743B1

(12) United States Patent
Webber

(10) Patent No.: US 7,909,743 B1
(45) **Date of Patent: *Mar. 22, 2011**

(54) DUAL ACTION WEIGHTLIFTING MACHINE

(75) Inventor: Randall T. Webber, La Jolla, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/727,581

(22) Filed: Mar. 19, 2010

Related U.S. Application Data

(63) Continuation of application No. 11/929,372, filed on Oct. 30, 2007, now Pat. No. 7,713,179, which is a continuation of application No. 11/363,677, filed on Feb. 28, 2006, now Pat. No. 7,393,309.

(51) Int. Cl.
*A63B 21/078* (2006.01)
*A63B 21/06* (2006.01)

(52) U.S. Cl. ..... 482/104; 482/94

(58) Field of Classification Search ..... 482/92, 482/93, 94, 98, 104; 211/85.7, 60.1, 13.1
See application file for complete search history.

(56) References Cited

U.S. PATENT DOCUMENTS

| | | | |
|---|---|---|---|
| 3,235,255 | A | 2/1966 | Leflar |
| 3,359,802 | A | 12/1967 | Sollenberger |
| 3,606,318 | A | 9/1971 | Gilstrap |
| 3,612,523 | A | 10/1971 | Glynn |
| 3,948,513 | A | 4/1976 | Pfotenhauer |
| 3,953,025 | A | 4/1976 | Mazman |
| 4,072,309 | A | 2/1978 | Wilson |
| 4,252,314 | A | 2/1981 | Ceppo |
| 4,286,782 | A | 9/1981 | Fuhrhop |
| 4,357,010 | A | 11/1982 | Telle |
| RE31,170 | E | 3/1983 | Mazman |
| 4,487,413 | A | 12/1984 | Fall |
| 4,527,797 | A | 7/1985 | Slade, Jr. et al. |
| 4,564,194 | A | 1/1986 | Dawson |
| 4,602,785 | A | 7/1986 | Rockwell |

(Continued)

FOREIGN PATENT DOCUMENTS

FR 1447999 6/1966

(Continued)

OTHER PUBLICATIONS

U.S. Appl. No. 29/297,619, filed Nov. 14, 2007, Webber.

(Continued)

*Primary Examiner* — Loan Thanh
*Assistant Examiner* — Sundhara M Ganesan
(74) *Attorney, Agent, or Firm* — Procopio, Cory, Hargreaves & Savitch LLP

(57) ABSTRACT

A dual action weightlifting machine has a stationary frame including a racking portion and spaced vertical guides slidably mounted on opposite sides of the frame for horizontal movement relative to the frame. A horizontally extending exercise bar assembly has spaced first and second vertical slides slidably mounted on the vertical guides, a user engaging portion for gripping by a user, at least one rack engaging portion having a smooth cylindrical surface which directly engages a selected support portion of the rack assembly in a racked position of the exercise bar assembly, and opposite first and second end portions for receiving one or more selected weights. The user engaging portion is located between the opposite sides of the frame and has a central longitudinal axis which is aligned and coaxial with the cylindrical surface of the rack engaging portion.

19 Claims, 38 Drawing Sheets

U.S. PATENT DOCUMENTS

| | | | | | |
|---|---|---|---|---|---|
| 4,615,524 | A | | 10/1986 | Sutherland | |
| 4,664,370 | A | | 5/1987 | Finch | |
| 4,700,944 | A | | 10/1987 | Sterba | |
| 4,744,560 | A | | 5/1988 | Azari | |
| 4,795,149 | A | * | 1/1989 | Pearson | 482/98 |
| 4,799,672 | A | | 1/1989 | Barrett | |
| 4,836,535 | A | | 6/1989 | Pearson | |
| D303,697 | S | | 9/1989 | Pearson | |
| D305,256 | S | | 12/1989 | Pearson | |
| 4,928,961 | A | | 5/1990 | Madden | |
| 4,934,693 | A | | 6/1990 | Santoro | |
| 4,955,604 | A | | 9/1990 | Pogue | |
| 4,974,838 | A | | 12/1990 | Sollenberger | |
| 4,978,122 | A | | 12/1990 | Dibowski | |
| 4,979,737 | A | | 12/1990 | Kock | |
| 4,982,957 | A | | 1/1991 | Shields | |
| 4,998,723 | A | | 3/1991 | Santoro | |
| 5,050,868 | A | | 9/1991 | Pearson | |
| 5,072,932 | A | | 12/1991 | Johnson | |
| 5,135,453 | A | | 8/1992 | Sollenberger | |
| 5,151,072 | A | | 9/1992 | Cone | |
| 5,184,992 | A | | 2/1993 | Banks | |
| 5,215,510 | A | * | 6/1993 | Baran | 482/104 |
| 5,257,964 | A | | 11/1993 | Petters | |
| 5,273,506 | A | | 12/1993 | Dawson, Jr. | |
| 5,334,120 | A | | 8/1994 | Rasmussen | |
| 5,407,403 | A | * | 4/1995 | Coleman | 482/6 |
| 5,447,308 | A | | 9/1995 | Girard | |
| 5,468,203 | A | | 11/1995 | Okonkwo | |
| 5,496,243 | A | | 3/1996 | Allen | |
| 5,569,133 | A | | 10/1996 | Vittone | |
| 5,669,859 | A | * | 9/1997 | Liggett et al. | 482/94 |
| 5,842,961 | A | | 12/1998 | Davis | |
| 5,971,897 | A | | 10/1999 | Olson et al. | |
| 6,120,424 | A | | 9/2000 | Arline | |
| D454,930 | S | | 3/2002 | Novak | |
| D455,310 | S | * | 4/2002 | Webber | D6/552 |
| 6,623,409 | B1 | | 9/2003 | Abelbeck | |
| 6,663,542 | B1 | * | 12/2003 | Trabbic | 482/106 |
| 6,685,601 | B1 | | 2/2004 | Knapp | |
| 6,811,521 | B1 | | 11/2004 | Musso | |
| 6,926,649 | B2 | | 8/2005 | Slawinski | |
| 6,939,274 | B2 | | 9/2005 | Emick | |
| D512,471 | S | | 12/2005 | Panatta | |
| 6,974,039 | B2 | | 12/2005 | Comartin et al. | |
| 7,014,601 | B2 | | 3/2006 | Savage et al. | |
| 7,086,999 | B2 | | 8/2006 | Jeneve et al. | |
| 7,097,601 | B1 | | 8/2006 | Ronnow | |
| 7,131,937 | B2 | | 11/2006 | Skilken et al. | |
| 7,163,496 | B1 | | 1/2007 | Trotter | |
| 7,163,498 | B1 | | 1/2007 | Abelbeck | |
| D560,089 | S | | 1/2008 | DeMeyer | |
| 7,331,911 | B2 | | 2/2008 | Webber et al. | |
| 7,364,536 | B2 | | 4/2008 | Cappellini et al. | |
| 7,374,516 | B2 | * | 5/2008 | Lundquist | 482/104 |
| 7,393,309 | B2 | | 7/2008 | Webber | |
| D583,426 | S | | 12/2008 | Webber | |
| D590,032 | S | | 4/2009 | Webber | |
| 7,713,179 | B2 | | 5/2010 | Webber | |
| 2002/0098953 | A1 | | 7/2002 | Scheewe et al. | |
| 2002/0169055 | A1 | | 11/2002 | Kras | |
| 2003/0022767 | A1 | | 1/2003 | Webber | |
| 2004/0157711 | A1 | | 8/2004 | Regev | |
| 2006/0252612 | A1 | * | 11/2006 | Melcer | 482/94 |
| 2007/0042876 | A1 | | 2/2007 | Lundquist | |
| 2007/0066456 | A1 | | 3/2007 | Kim | |
| 2007/0203002 | A1 | | 8/2007 | Webber | |
| 2008/0051264 | A1 | | 2/2008 | Webber | |
| 2009/0124469 | A1 | | 5/2009 | Webber | |

FOREIGN PATENT DOCUMENTS

| | | |
|---|---|---|
| FR | 2328486 | 5/1977 |
| WO | WO9220409 | 11/1992 |
| WO | WO9222357 | 12/1992 |

OTHER PUBLICATIONS

U.S. Appl. No. 29/297,625, filed Nov. 14, 2007, Webber.
Criterion Bodybuilding Brochure; Leg Machine; Shoulder Machine; Back Machine; Chest Machine, Mass Production, Inc. Criterion Bodybuilding Equipment, date unknown, 12 pages.
Floating Smith Press No. 1330, Serious Lifting Systems Brochure, date unknown, 4 pages.
Hoist Full Cage and Half Cage Ensemble, Hoist Fitness Systems Catalog, 2000, 4 pages.
Hoist HFOPT 900-02, pages from Owner's Manual, Jan. 2000, 5 pages.
LS545 Max Rack, Lamar Health, Fitness & Sports LLC, date unknown, 2 pages.
Max Rack 3-D Flyer, date unknown, 1 page.
Max Rack Pro Trainer, Operation Manual, Max Rack Inc., 1997, 35 pages.
Max Rack Studio Operations Manual, Max Rack Inc., date unknown, 17 pages.
Max Rack U.S. Smith Machines, date unknown, 1 page.
Multi-Adjustable Bench FB321, Life Fitness 2002, 1 page.
Natural Motion Self Sporting Free Weight Machine, Max Rack Brochure, date unknown, 2 pages.
Pending U.S. Appl. No. 11/940,009 to Webber et al. filed Nov. 14, 2007.
Smith Machine FSSM, Life Fitness 2005, 1 page.
Smith Machine PFW-7700, Paramount Fitness 2002, 1 page.
Super Smith II, 2 Axis Smith Machine, Hard Kore Brochure, date unknown, 6 pages.
The Jones, BodyCraft web page, http://www.bodycraft.com/jones.tpl, original date of publication unknown, 1 page.
The Max Rack Squat Machine, Max Rack Inc., date unknown, 1 page.
The Slammer, Positrak brochure, date unknown, 1 page.
Thomson Linear Motion Technology Guide, Thomson Industries Inc., pp. 3 and 9-15, date unknown, 9 pages.
Yukon Caribou II Gym, date unknown, 1 page.
Max Rack 3-D Flyer, 2004, 1 page.

* cited by examiner

DUAL ACTION WEIGHTLIFTING MACHINE

RELATED APPLICATION

The present application is a Continuation of co-pending U.S. patent application Ser. No. 11/929,372 filed on Oct. 30, 2007, which is a Continuation of U.S. patent application Ser. No. 11/363,677 filed on Feb. 28, 2006, now issued as U.S. Pat. No. 7,393,309, the contents of each of which are incorporated herein by reference in their entirety.

BACKGROUND

1. Field of the Invention

This invention relates generally to exercise machines, and is particularly concerned with exercise machines of the type which simulate free weight barbell exercise movements.

2. Related Art

Weightlifting machines with weight bars for simulating barbells, also known as Smith machines, have been a fitness club staple for many years. The basic machine has a barbell attached to slide mechanisms which run on vertical guides on opposite sides of a stationary frame. This allows an exerciser to perform exercises with vertical up and down movement, such as squats, bench press exercises, and the like, but does not permit any horizontal movement. The exerciser does not have to worry about balancing the side-to-side or front-to-back movement of an independent, free weight bar. The premise is that this design provides an additional measure of safety and is easy for the neophyte to use.

The first Smith machines had the vertical guides running perpendicular to the floor, which worked well for some exercises such as squats but fought the natural chest-to-chin arcing movement of a bench press. Manufacturers soon started designing Smith machines that placed the vertical guides at a slight (five to seven degrees) angle. These new designs worked better for exercises which involved travel in a slight arc, but not as well for other exercise motions which tended to follow a straight line.

The next evolution came with the advent of composite motion or dual action Smith machines that provided simultaneous horizontal and vertical exercise motion. These designs allowed the exercise bar to follow a natural front-to-back exercise motion but still eliminated the side-to-side balancing worries. They provided a halfway point between the balance and coordination needed to perform free weight exercises and the security of a traditional Smith machine. These designs also provided the ability to perform exercises such as lunges which require greater horizontal movement.

Dual motion weightlifting machines typically have a horizontal exercise bar which is slidably mounted at its opposite ends on two vertical guide bars. Each vertical guide bar in turn is slidably mounted on horizontal guide bars at its upper and lower ends. This allows the exercise bar to move simultaneously in vertical and horizontal directions, so that the exerciser can perform a more natural feeling weightlifting exercise which allows for the natural horizontal movements of the arms while pushing a weight upwards. The weight bearing bar or exercise bar is normally a standard Olympic bar, which may have hooks attached to it on a rotatable sleeve for hooking onto pinning holes on vertical guides so as to hold the bar in a rest position. The usual weight for an Olympic bar is between forty and fifty pounds. By attaching hooks, bearings, and vertical slides, the weight is dramatically increased. In some cases, counterweights are added to help reduce the weight or inertia required to move the bar from a rest position.

While this counterbalance offsets the vertical weight, horizontal weight is increased. It also adds to the complexity and expense of the machine.

SUMMARY

Embodiments described herein provide for a dual action weightlifting machine which has an exercise bar assembly including slides on vertical guides slidably mounted for horizontal movement along opposite sides of a stationary frame.

According to one aspect, the frame has at least one pair of upright struts at one end, each upright strut having a plurality of spaced support or racking portions such as hooks or teeth. The racking portions are designed to receive and support spaced rack engaging portions of the exercise bar in a rest position. When the user is in position gripping the exercise bar, they can place the bar on a pair of aligned hooks or teeth on the two struts. The rack engaging portions comprise cylindrical surfaces outside the vertical guide on each side of the machine, and in one embodiment the cylindrical surfaces are placed directly onto the respective hooks or teeth at the end of an exercise or if a user is unable to finish an exercise. Safety stops are provided on each side of the frame for catching the bar if it is dropped.

In one embodiment, the weight bearing exercise bar comprises two end portions each having a vertical slide for slidably engaging a respective vertical guide, a weight receiving end projecting in one, outward direction from the slide and a shaft projecting in an opposite, inward direction from the slide, and a sleeve rotatably engaged on the shafts at its opposite ends. This makes the exercise bar much lighter, and the sleeve does not have any hooks or other devices for engaging on the stationary frame. Instead, each end portion engages directly on hooks provided on upright struts of the frame. The sleeve may have 360 degrees of unobstructed rotation to allow the user to perform a greater variety of exercises.

The dual action weightlifting machine allows simultaneous horizontal and vertical movement of an exercise bar and simulates a free barbell exercise. The central sleeve section of the exercise bar provides free rotation, duplicating the feel of a barbell.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Figure 1:
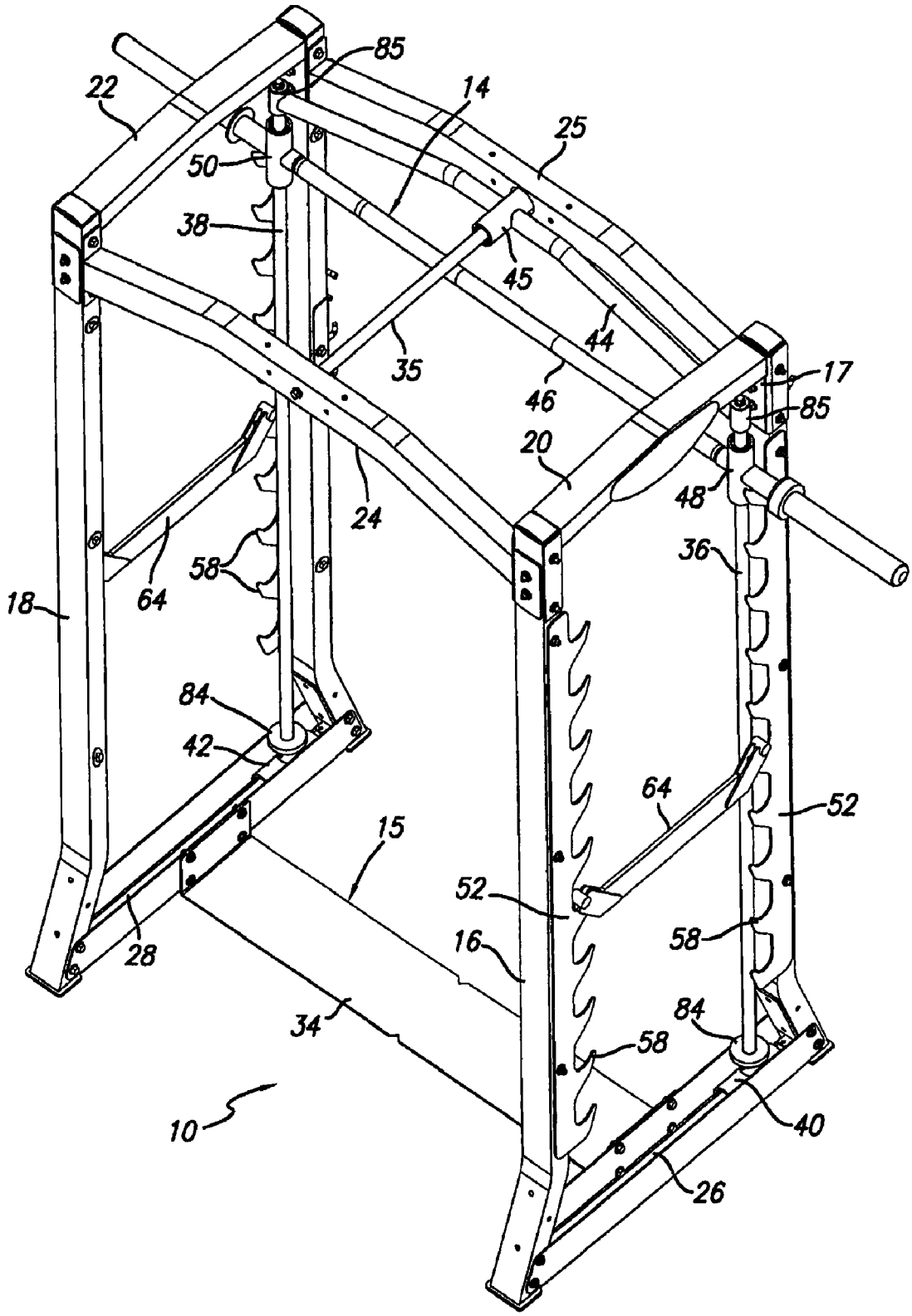
FIG. 1 is a top perspective view of a dual action weightlifting machine according to a first embodiment.

Certain embodiments as disclosed herein provide for a dual action weightlifting exercise machine having upper and lower horizontal guides and horizontally spaced vertical guides allowing vertical and horizontal movement of a weight bearing exercise bar which has rack engaging portions outside the vertical guides which are coaxial with a user engaging portion of the exercise bar.

After reading this description it will become apparent to one skilled in the art how to implement the invention in various alternative embodiments and alternative applications. However, although various embodiments of the present invention are described herein, it is understood that these embodiments are presented by way of example only, and not limitation.

FIGS. 1 to 10 illustrate a dual action weightlifting exercise machine 10 according to a first embodiment. The apparatus basically comprises a stationary main frame 12 and an exercise unit 14 movably mounted on the stationary frame. The movable exercise unit 14 is shown separately in FIG. 9, with most of the stationary frame parts removed for clarity.

The stationary frame 12 has an upper end, a lower end, a front, a rear and opposite left and right sides, and is designed to support the movable exercise unit. Frame 12 has a floor engaging base 15, first and second pairs of upright struts 16, 17 and 18, 19, respectively, upper struts 20, 22 extending between the upper ends of each pair of upright struts, and upper cross struts 24, 25, the first upper cross strut 24 extending between the upper ends of the front upright strut 16, 18 of each pair, and the second upper cross strut 25 extending between the upper ends of the second upright strut 17, 19 of each pair. A lower horizontal guide or guide assembly having a pair of lower horizontal guide bars 26, 28 extends between the lower ends of each pair of cross struts at the lower end of the machine. The guide bars 26, 28 are located in a channel or shield member 30, 32 respectively, forming part of the base of the machine, for shielding users from moving parts of the machine. One of the channel members is removed in FIG. 2 to reveal the slide mechanism in more detail. A base connecting plate 34 extends between the base channel members 30, 32 and engages the floor for added stability. An upper horizontal guide or guide assembly having a single upper horizontal guide bar 35 extends between the two upper cross struts 24, 25 at a central position offset from the lower horizontal guide bars 26, 28. The lower guide assembly includes traveling members or slides 40, 42 which are slidably or movably engaged with the respective horizontal guide bars 26, 28. The upper guide assembly includes a traveling member or slide 45 movably engaged with upper guide bar 35.

Figure 9:
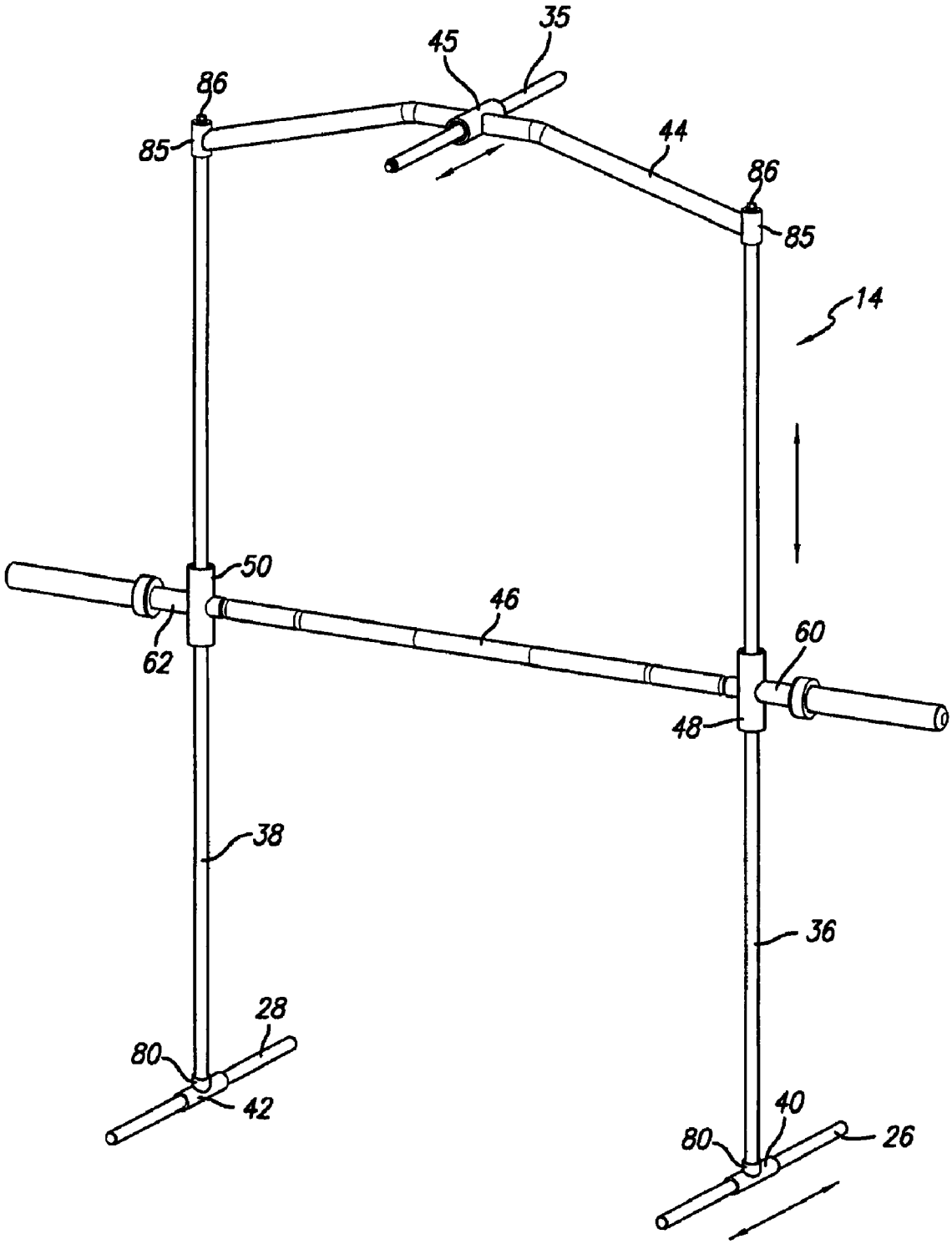
FIG. 9 is a perspective view showing only the components of the movable exercise unit of the machine of FIGS. 1 to 8, with stationary components of the machine removed.

As best illustrated with reference to FIGS. 1, 2 and 9, the movable exercise unit 14 comprises a pair of vertical guides 36, 38 each slidably mounted at their lower ends on a respective horizontal guide bar 26, 28 via horizontal slides 40, 42, a cross bar 44 extending between the upper ends of the vertical guides and slidably connected to the upper horizontal guide bar 35 via upper horizontal slide 45, and a weight bearing exercise bar 46 extending between the vertical guides and slidably linked to the vertical guides by vertical slides 48, 50. This arrangement provides simultaneous vertical and horizontal guided movement of the exercise bar 46, as indicated by the arrows in FIG. 9. Portions of the lower and upper horizontal guide bars of the frame are included in FIG. 9 for clarity. The vertical guides 36, 38 move horizontally back and forth on the lower guide bars 26, 28 and upper guide bar 35, while the exercise bar 46 can move vertically up and down on the vertical guides, providing for simultaneous horizontal and vertical movement of the exercise bar.

Figure 7:
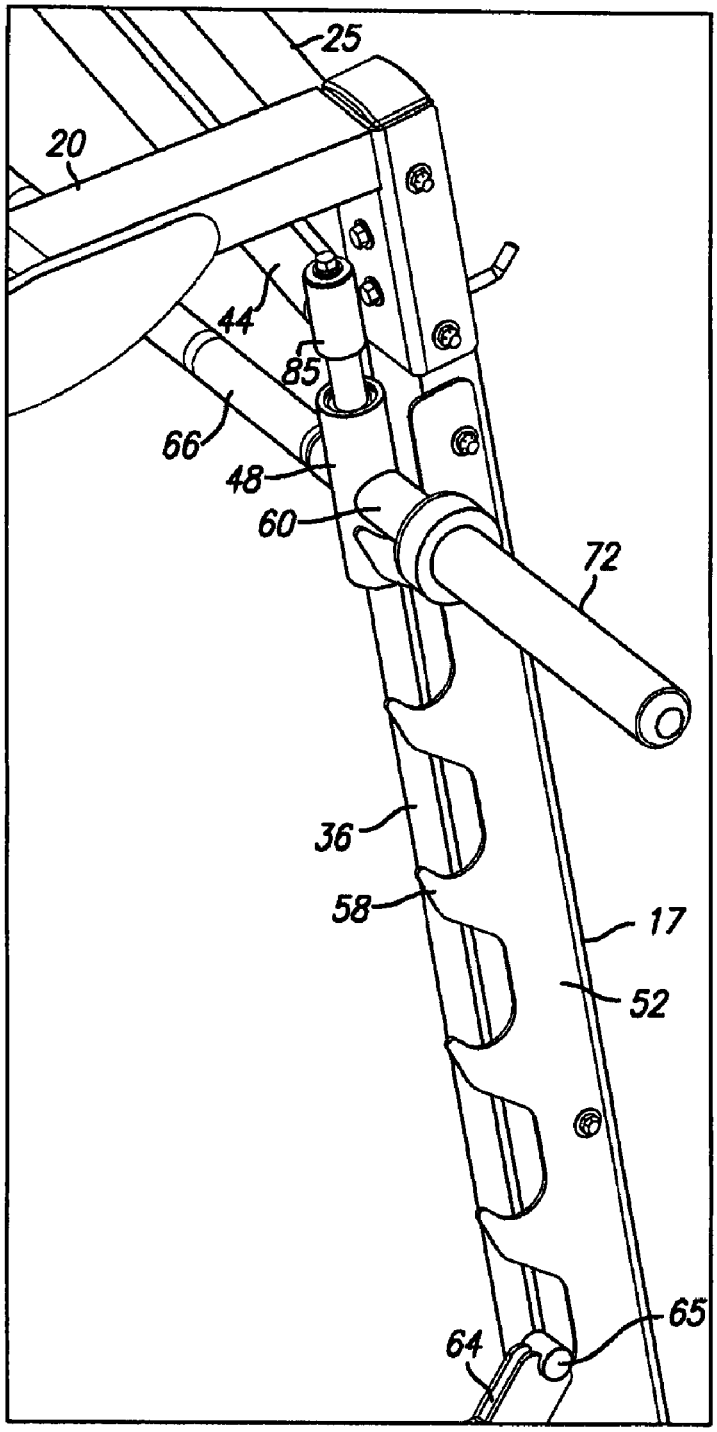
FIG. 7 is an enlarged view of an upper part of an upright strut of the frame, showing how the exercise bar racks directly onto a hook on a racking plate.

The main frame includes a rack assembly for supporting the exercise bar in multiple possible positions when not in use. The rack assembly comprises vertical rack plates 52 mounted on each of the upright struts 16, 17, 18 and 19, as illustrated in FIGS. 1, 2, 3, 5, 7 and 8. The vertical rack plate 52 on upright strut 18 is not visible, but is identical in position to the rack plate 52 on the other front upright strut 16. The rack plates each have a series of spaced teeth or upwardly directed hooks 58, with the hooks on front upright struts 16 and 18 facing the hooks on the rear upright struts 17 and 19, and the hooks on the front upright struts and rear upright struts all aligned with one another. When a user wishes to place the exercise bar in a rest position, they simply engage portions 60, 62 of the bar 46 in a respective pair of aligned hooks 58 on the two front upright struts 16, 18 or the two rear upright struts 17, 19. Hook engaging portions 60, 62 are immediately adjacent and outboard of the respective vertical slides 48 and 50. FIGS. 1 and 2 illustrate the bar engaged in the two uppermost hooks 58 of the rear upright struts 17, 19, while FIG. 7 is an enlarged view illustrating the engagement of hook engaging portion 60 in the uppermost hook 58 on the upright strut 17. Weight plates can be added or removed from the weight receiving ends 72, 74 of the exercise bar when it is in the rest position racked onto two of the toothed plates 52, and the exercise bar can be left in this position for storage purposes when the machine is not in use.

Figure 2:
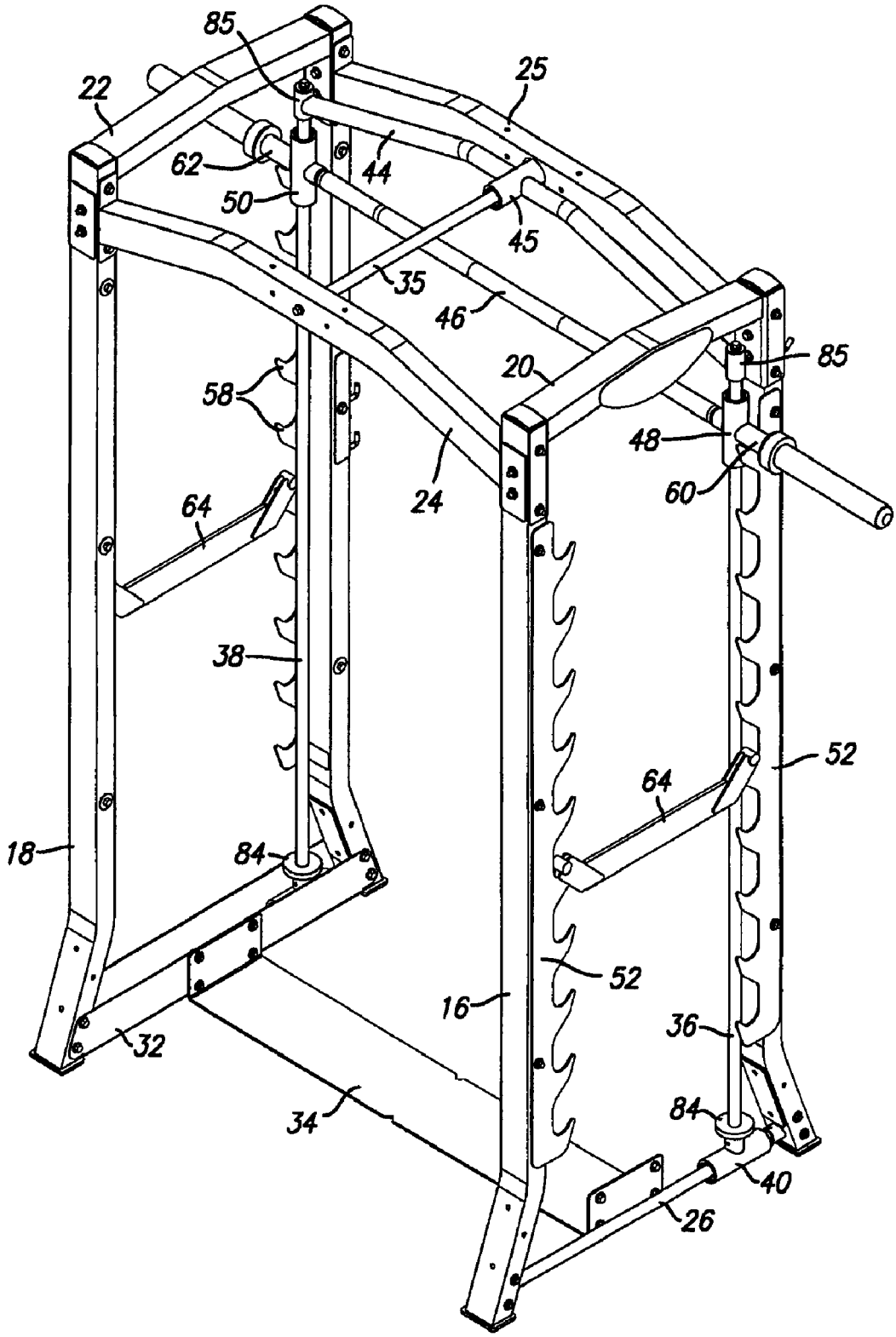
FIG. 2 is a front perspective view of the machine of FIG. 1, with part of the base frame removed to reveal a lower horizontal guide and slide.
Figure 3:
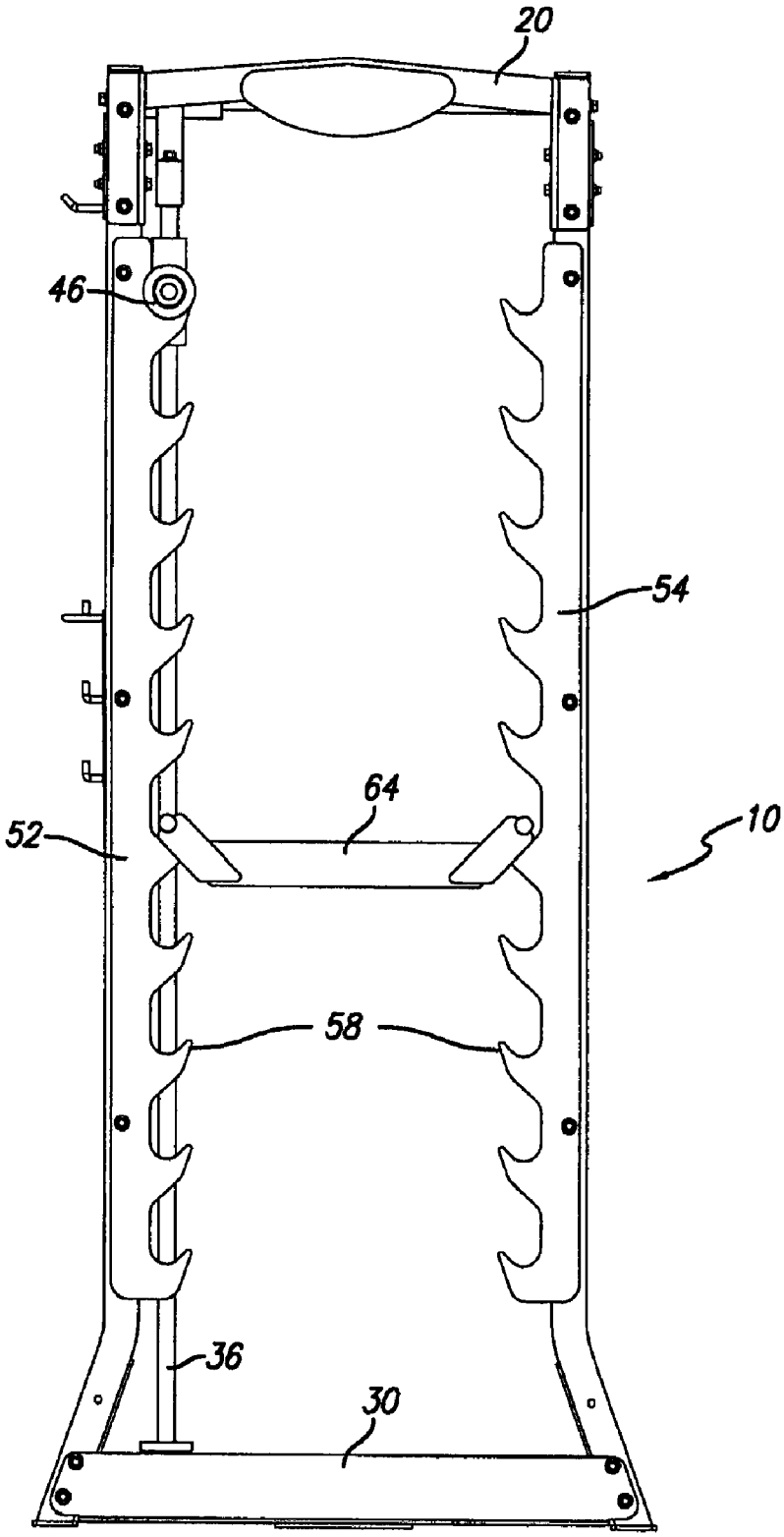
FIG. 3 is a side elevation view of the machine of FIGS. 1 and 2.
Figure 4:
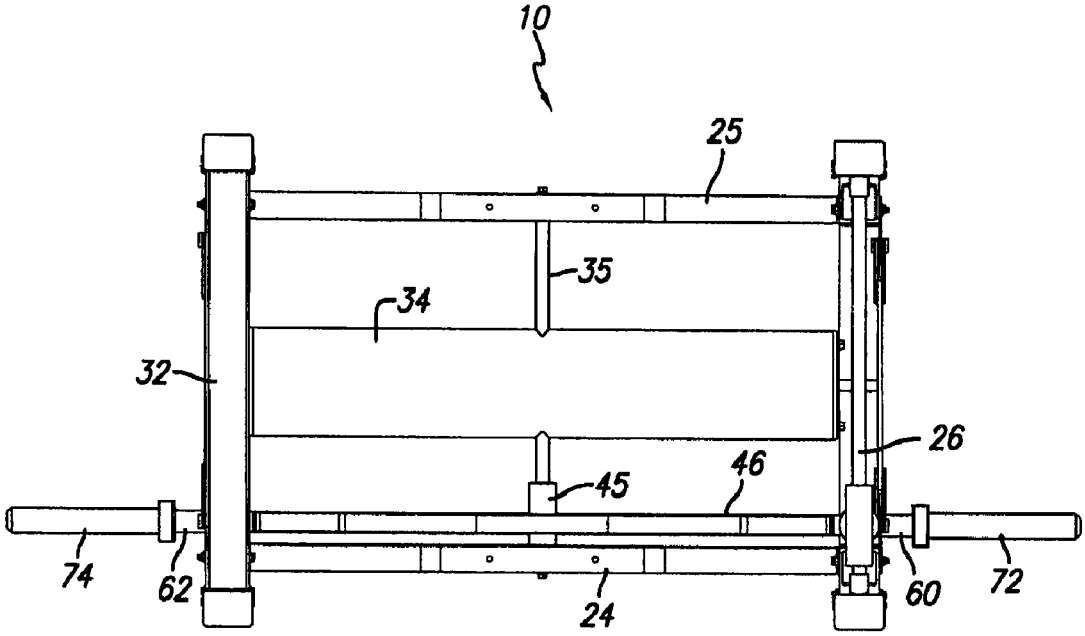
FIG. 4 is a bottom plan view of the machine of FIGS. 1 to 3 with part of the base frame removed to reveal a lower horizontal guide and slide.

A pair of safety tiers 64 is provided for engagement between respective pairs of rack plates 52 on opposite sides of the main frame, as best illustrated in FIGS. 1 and 2. The tiers 64 have pins 65 at their ends which can engage on hooks or teeth 58 as illustrated in FIG. 7. The safety tiers can be adjusted as necessary, depending on the type of exercise, to provide the user with protection against losing control of a weighted exercise bar.

Figure 10:
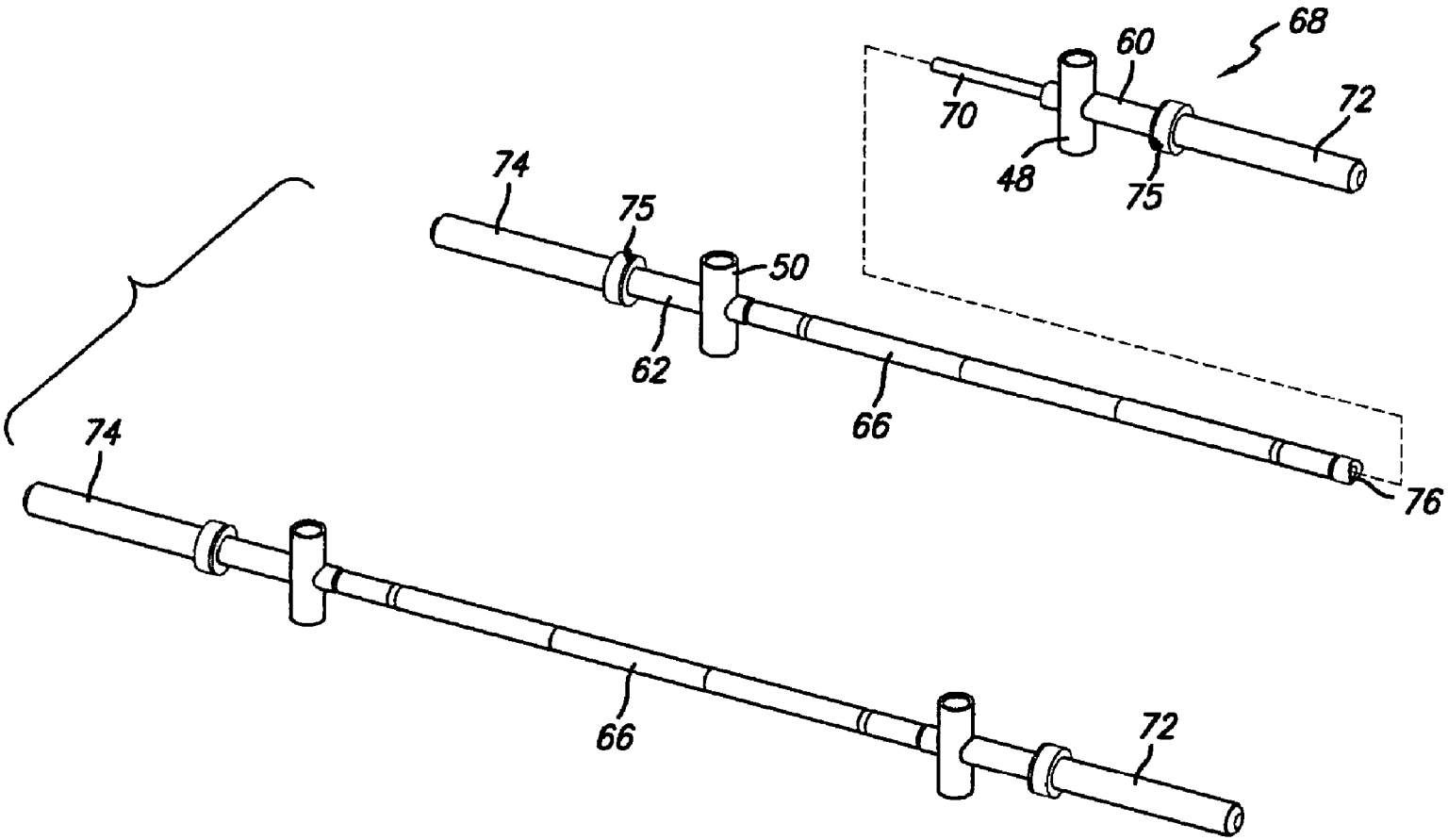
FIG. 10 is a perspective view of the exercise bar with one end of the bar separated from the rotating sleeve.

The components of the weighted exercise bar 46 are illustrated in more detail in FIG. 10. The exercise bar 46 comprises a central, hollow rotating sleeve 66 which is rotatably mounted at each end on opposite end members 68, 69 of the bar. Each end member 68, 69 incorporates a respective vertical slide 48, 50, and has an inwardly extending shaft or axle 70 on which a respective end of the sleeve 66 is rotatably engaged. A weight receiving end 72, 74 projects outwardly from the respective vertical slide 48, 50, and a rack engaging portion 60, 62 between the respective slide 48, 50 and end 72,74 is designed to engage on aligned hooks 58 when the exercise bar is in the rest position. An annular stop 75 with a bumper is provided between the weight receiving outer end 72, 74 of each end member 68, 69 and the hook or rack engaging portion 60, 62. The rack engaging end portions 60, 62 have a larger diameter than the sleeve or user engaging portion 66 of the exercise bar, as illustrated in FIG. 10. A bushing 76 at each open end of the sleeve 66 releasably retains the rotating sleeve on the respective axle 70. This arrangement provides a freely rotatable sleeve for gripping by a user when performing exercises, with the sleeve having 360 degree, unrestrained rotation. The hollow sleeve construction provides a much lighter weight exercise bar than was used in many previous designs, and the vertical slides 48 and 50 are in line with the axis of the exercise bar, providing better weight distribution since the traveling exercise unit is centered on the exercise bar.

Figure 10A:
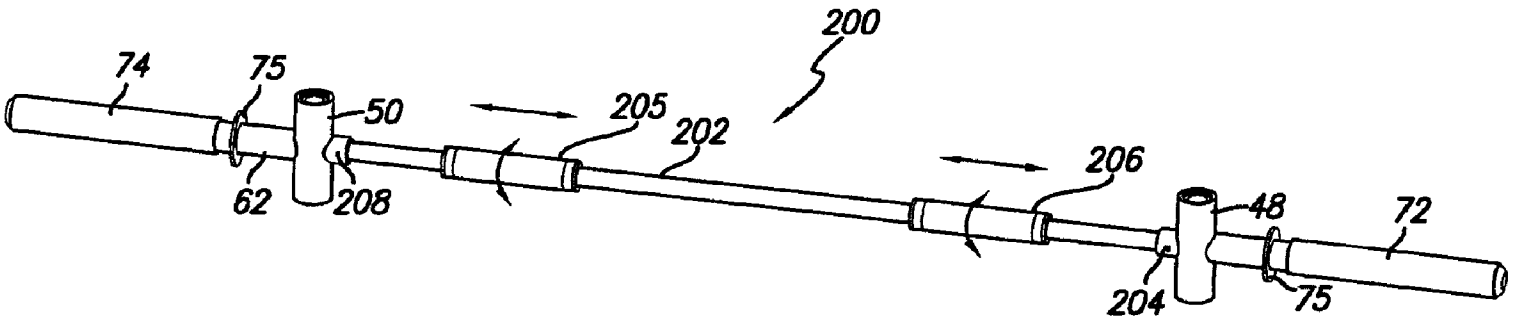
FIG. 10A is a perspective view of a modified exercise bar with two rotating hand grip sleeves.
Figure 10B:
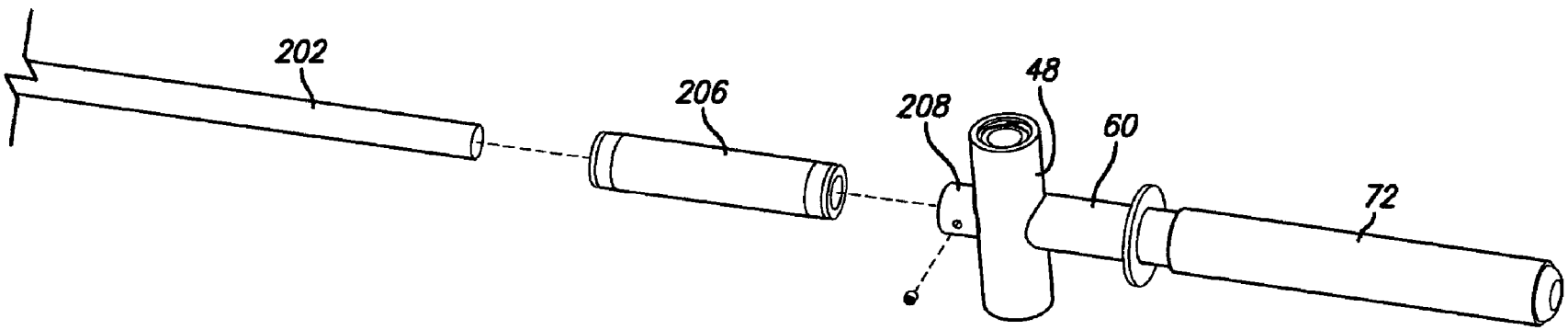
FIG. 10B is an exploded perspective view illustrating the separate components at one end of the exercise bar of FIG. 10A.
Figure 11:
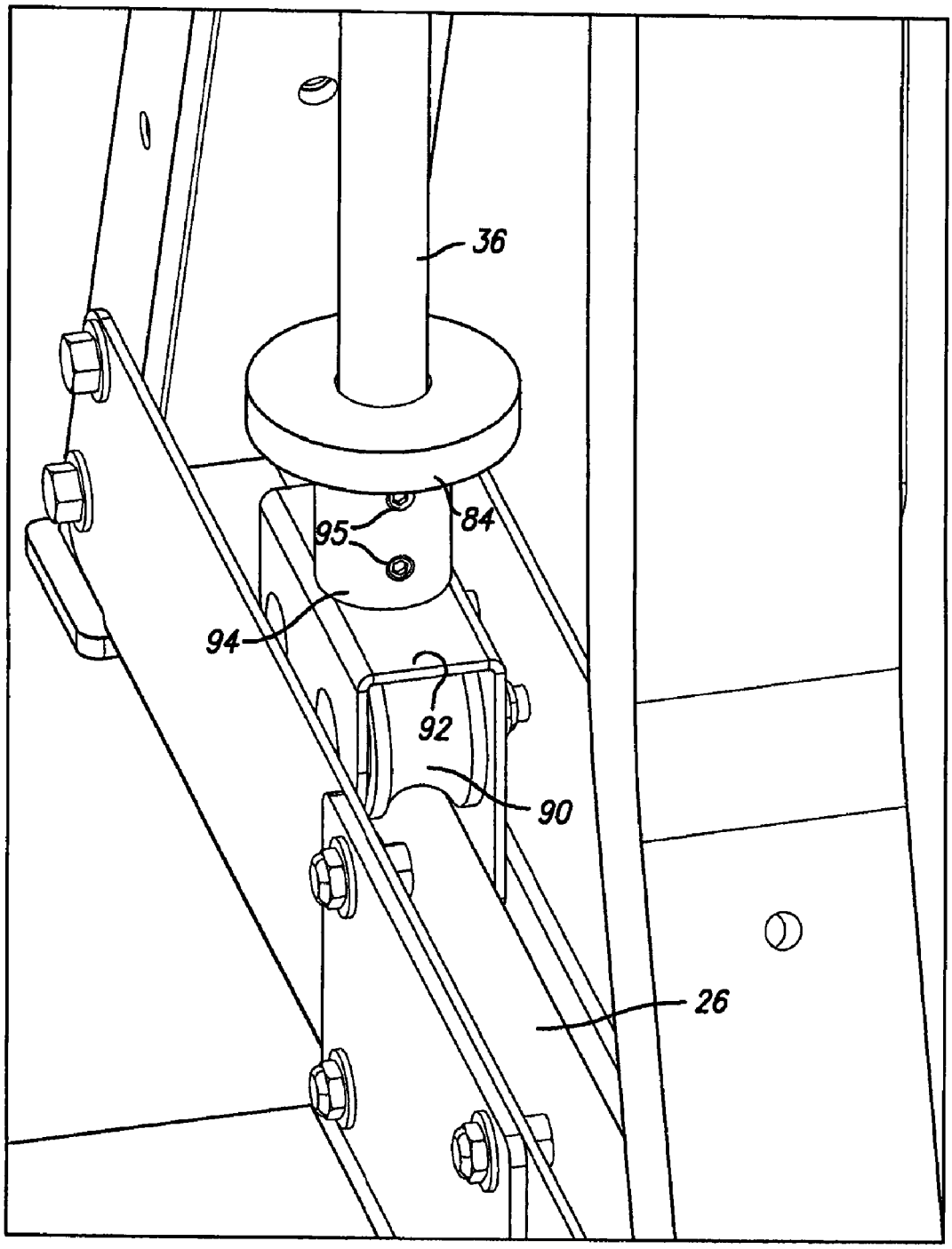
FIG. 11 is an enlarged perspective view of the lower end of the machine of FIGS. 1 to 10, illustrating an alternative lower horizontal slide replacing the linear bearing slide of FIG. 6.

FIGS. 10A and 10B illustrate a modified exercise bar 200. Rather than a single hollow rotating sleeve 66 extending between the vertical slides 48, 50, as in FIG. 10, this embodiment has a bar 202 extending between the vertical slides and rigidly secured to the vertical slide at each end via set screws 204, and a pair of shorter sleeves 205, 206 rotatably mounted on bar 202. Bar 202 extends through the sleeves and engages in short collar 208 projecting from the respective sleeve, and is secured in position via the set screw 204 extending through the collar and bar. The bar may be a solid bar or may be hollow to reduce the overall weight of the assembly. The sleeves 205, 206 are free to slide back and forth along the bar 202 and to rotate through 360 degrees about the bar, as indicated in FIG. 10A. The bumper of end stop 75 is omitted in FIGS. 10A and 10B for clarity but is identical to the bumpers illustrated on end stops 75 in FIG. 10. As best illustrated in FIG. 10B, each weight receiving end portion of the modified exercise bar 200 includes a protective outer sleeve. The rack engaging portions of both bar 46 and modified bar 200 are of substantially the same diameter as the weight receiving end portions, as illustrated in FIG. 10 and FIGS. 10A and 10B.

The provision of two rotating hand grip sleeves which are slidably mounted on an exercise bar as in FIGS. 10A and 10B provides greater versatility in hand grip adjustment both before and during an exercise movement. When the bar is pushed or pulled during a lifting exercise, the hands can diverge or converge in order to duplicate the types of exercises performed with separate dumbbells, such as a dumbbell press. The user can also adjust the width of their handgrip to the most comfortable position.

Figure 5:
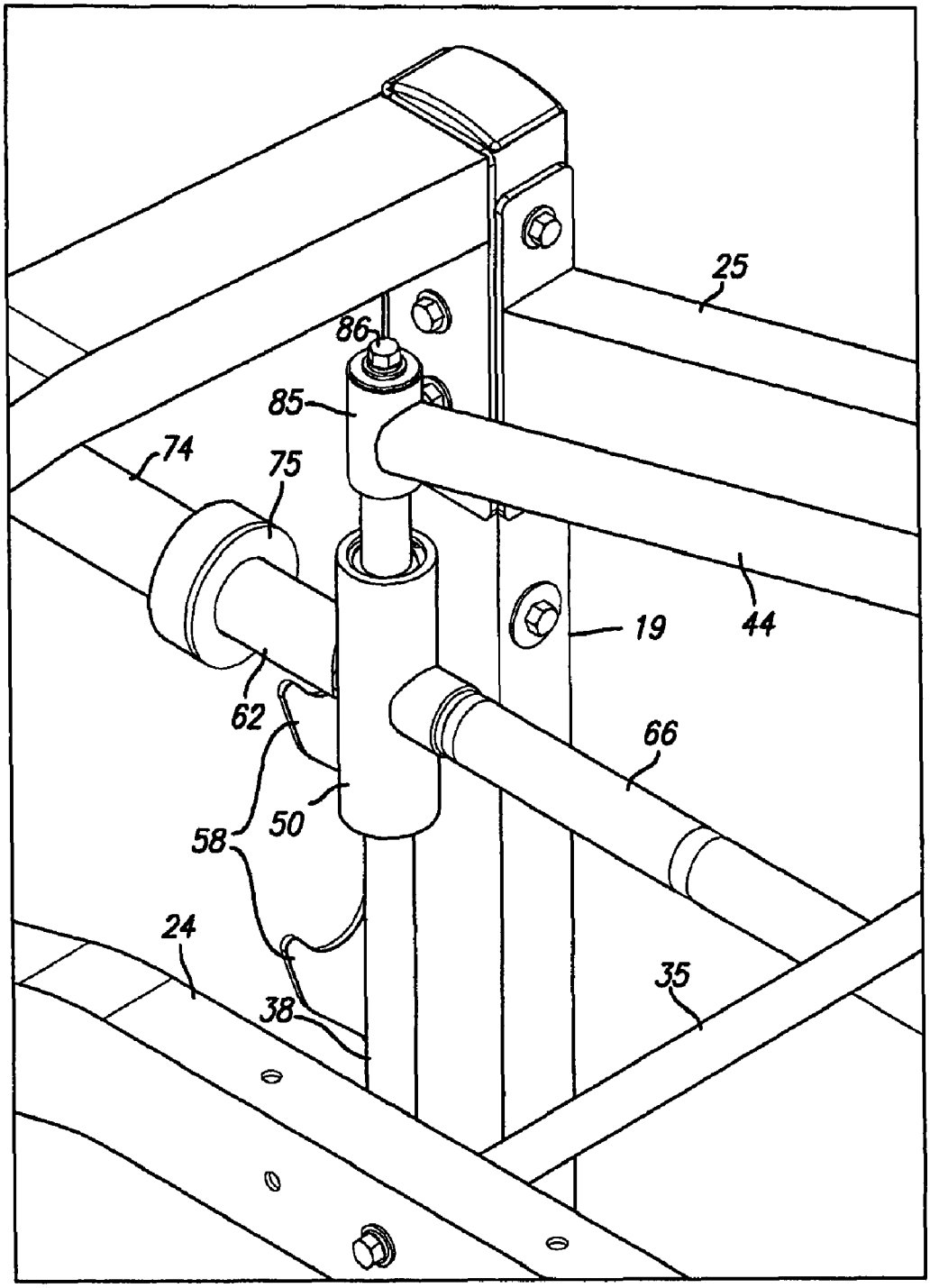
FIG. 5 is an enlarged perspective view of an upper portion of the machine, showing the rigid attachment of the cross bar to the upper end of the vertical guide.
Figure 6:
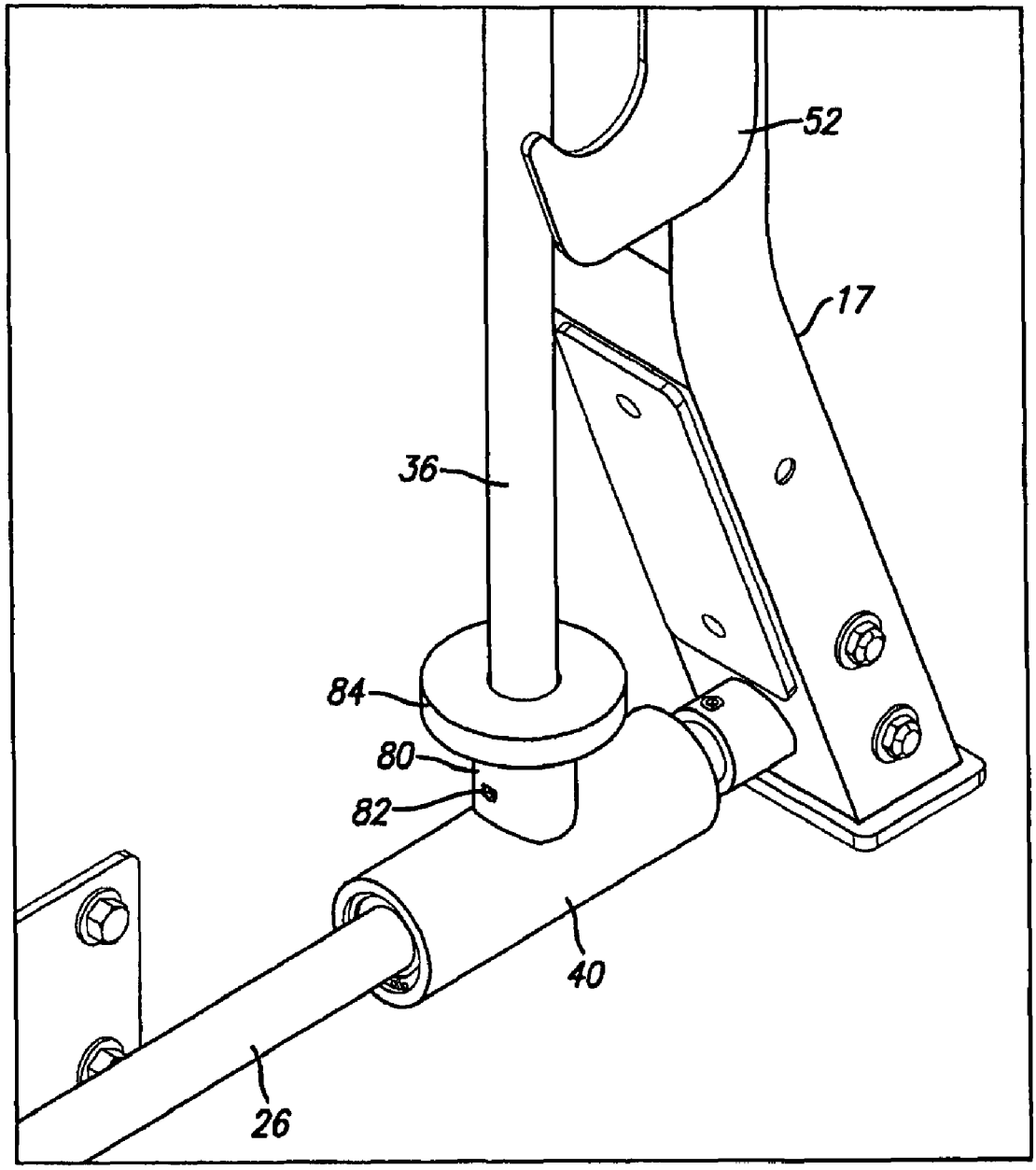
FIG. 6 is an enlarged view of a lower horizontal slide showing its rigid attachment to a vertical guide.

The horizontal and vertical slide connections between the moving exercise unit and the horizontal guide bars are seen in FIGS. 1, 2, 5, 6 and 9. As noted above, the exercise unit has two vertical guides 36 and 38 on opposite sides of the machine which are slidably engaged with respective horizontal guides 26, 28 at the base of the main frame via horizontal slides 40 and 42, respectively. FIG. 6 is a close up of one of the lower horizontal slides 40 showing its rigid attachment to the lower end of the vertical guide 26. The horizontal slides 40, 42 each comprise an outer sleeve housing a linear bearing which is telescopically engaged for smooth sliding motion along the respective horizontal guide 36, 38. A collar 80 projects upwardly from each horizontal slide and the lower end of the vertical guide 36 engages in the collar and is rigidly attached to the collar 80 by a set screw 82. A bumper 84 at the top of collar 80 provides a stop which engages the vertical slide 48 to prevent further downward movement of the exercise bar beyond this point. The vertical guide 28 is rigidly attached to the other lower horizontal slide 42 in an identical manner, and like reference numerals have been used for like parts in the drawings as appropriate.

FIG. 5 illustrates the attachment of the upper end of vertical guide 38 to the traveling cross bar 44. The upper end of the other vertical guide 36 is attached to the opposite end of the traveling cross bar in an identical manner, as seen in FIG. 7. Vertical caps 85 at opposite ends of cross bar 44 engage over the upper ends of the respective vertical guides and are rigidly attached to the vertical guides by bolts 86. The vertical slide 50 is seen adjacent the upper end of vertical guide 36 in FIG. 5. Each vertical slide also comprises a sleeve enclosing a linear bearing, like the lower horizontal slides 40 and 42. The single upper horizontal slide 45 at the center of cross bar 44 also comprises a sleeve enclosing a linear bearing. As best illustrated in FIGS. 1 and 2, the cross bar 44 connecting the upper ends of the two vertical guides has first and second portions extending transversely from slide 45 to the respective vertical guides 36, 38, and is arched upwardly at its center, as are the respective front and rear upper cross struts 24 and 25.

The horizontal movement of the movable exercise unit 14 is controlled by three horizontal guide bars mounted on the stationary main frame with three horizontal slides movably mounted on the respective guide bars and each secured to one or both vertical guides. The horizontal guides are offset from one another, rather than being aligned in the vertical direction as was the case with most prior art Smith machines. This vertical offset provides more stability and less play in the sliding motion of the exercise bar.

Figure 8:
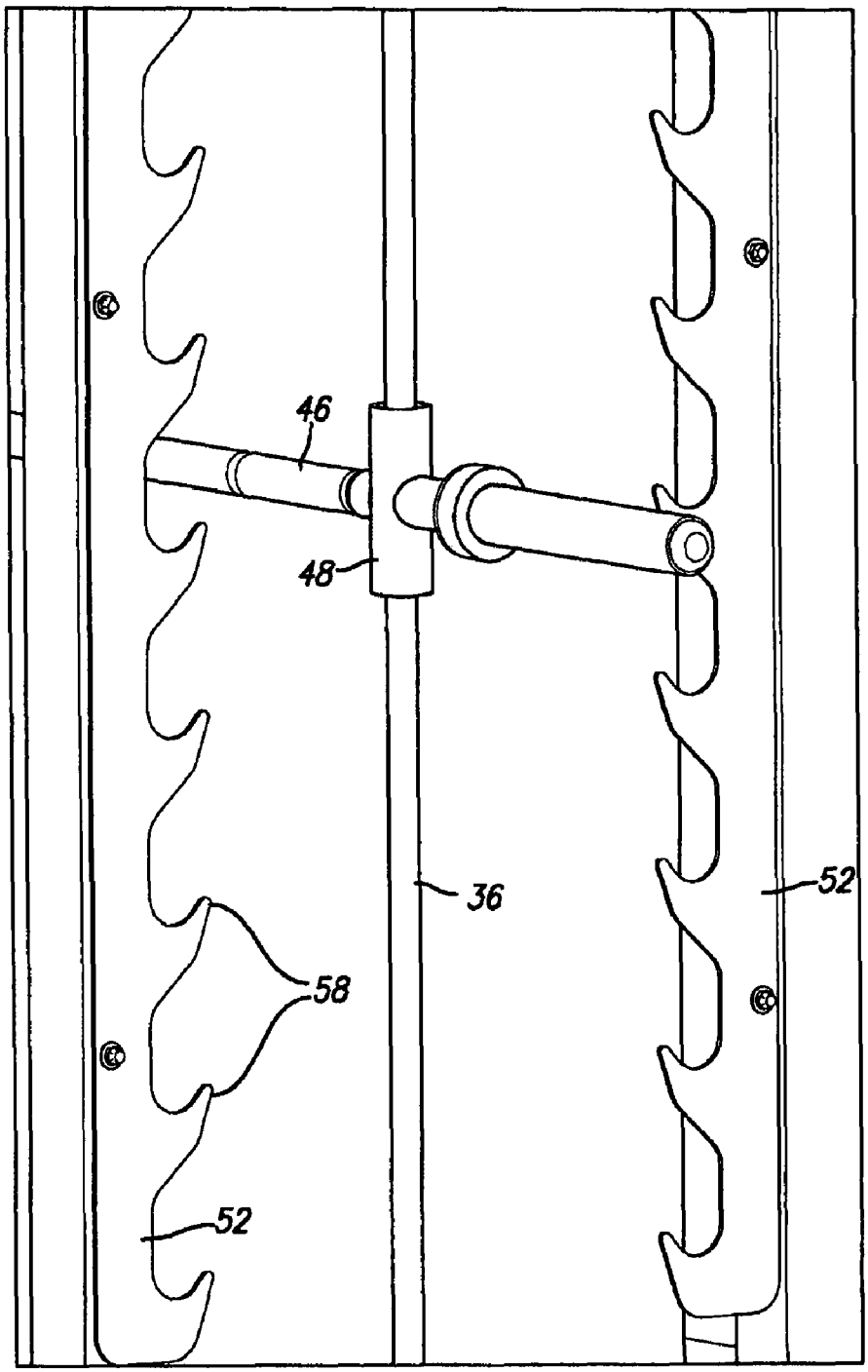
FIG. 8 is a perspective view of part of one side of the machine of FIGS. 1 to 7, showing the exercise bar removed from the racking plate.

Once the user engages the weight receiving exercise bar 46 and moves it from a rest position on the toothed plates and into an exercise ready position, as indicated in FIG. 8, the entire movable exercise unit 14 acts as one device to provide simultaneous horizontal movement. This allows a large variety of different exercises to be performed. The exercise unit 14 is relatively light weight due to the hollow sleeve design of the exercise bar and the use of only three horizontal slides rather than four which was common in the past, producing a smoother, and more fluid exercise motion. By reducing the weight of the exercise bar below that of a standard Olympic bar, this machine allows a novice user to handle the weight comfortably and safely, without needing the costly inclusion of any counter-balancing means.

The machine of FIGS. 1 to 10 has a reduced number of moving components in order to reduce the weight of the movable exercise unit, thus reducing the inertia required to initiate or change directions on the horizontal plane. Some free weight exercises require the horizontal motion to be paused or the direction of horizontal movement to be changed at the mid point of an exercise. The reduced weight of the movable exercise unit in this machine allows such exercises to be performed more easily. At the same time, the elimination of framework and reduction of the number of components reduces the overall cost and complexity of the machine.

Figure 12:
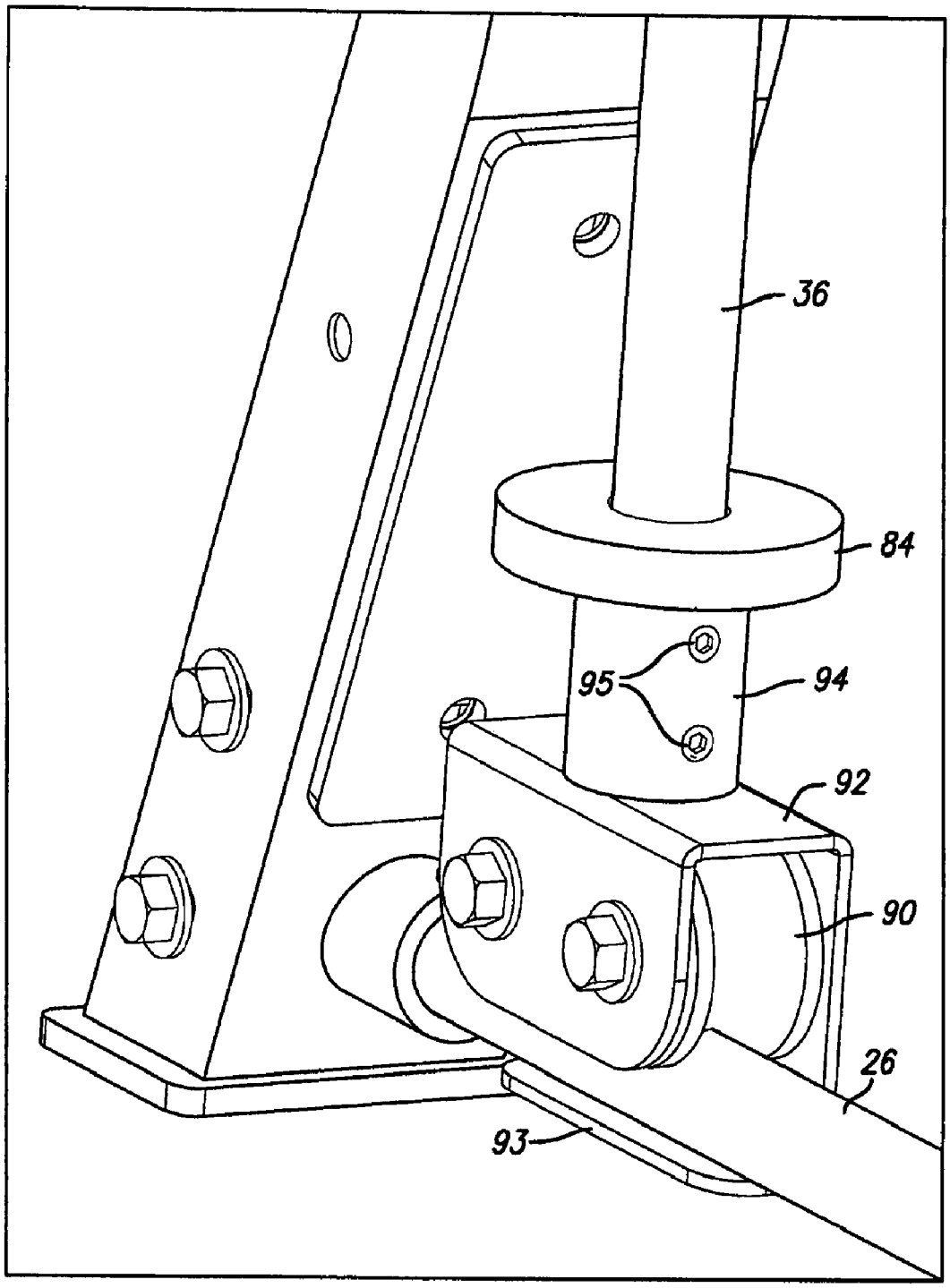
FIG. 12 is a view similar to FIG. 11 but with a portion of the stationary frame removed for clarity.
Figure 13:
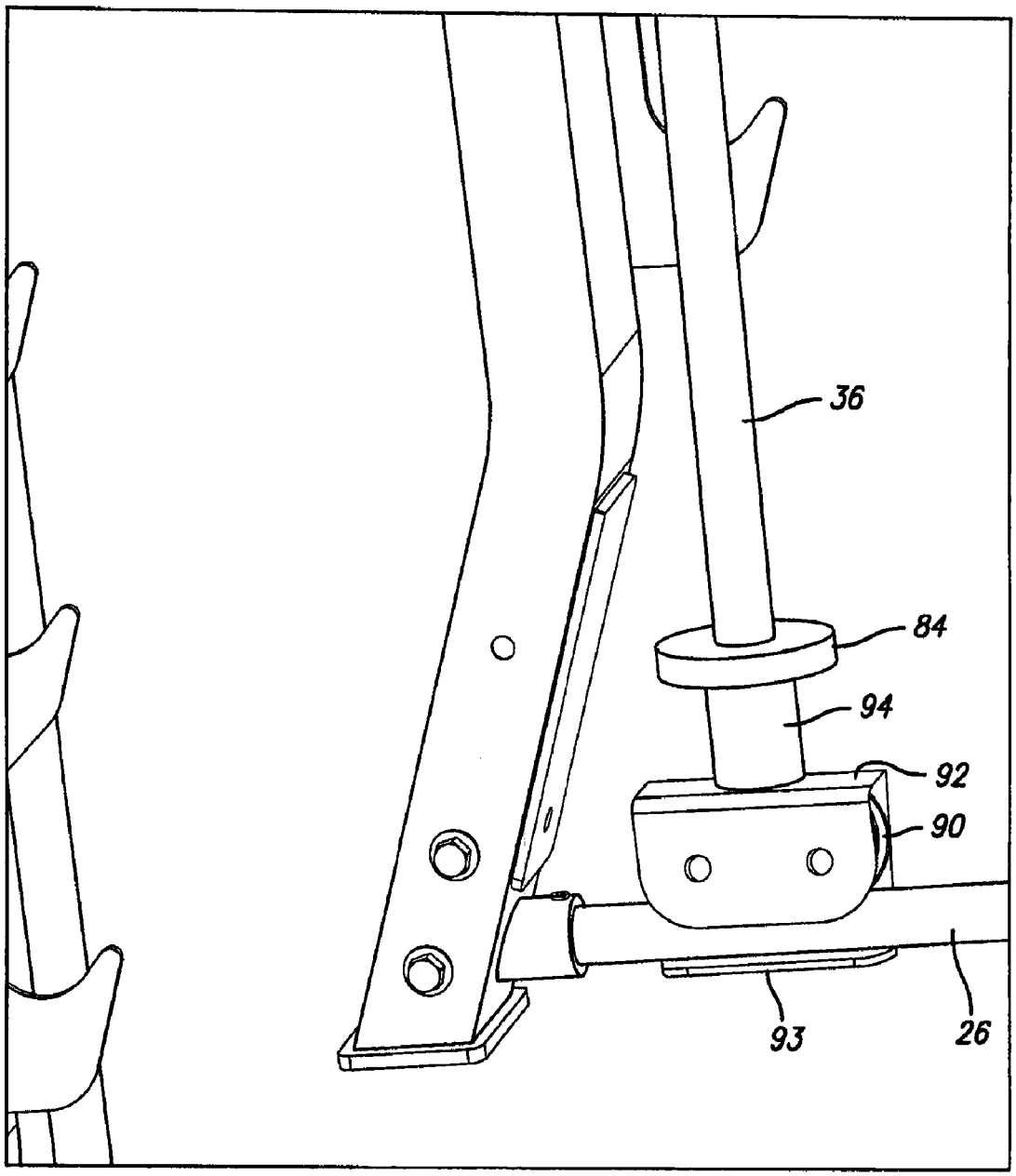
FIG. 13 is a side view of the modified lower horizontal slide of FIGS. 11 and 12.
Figure 14:
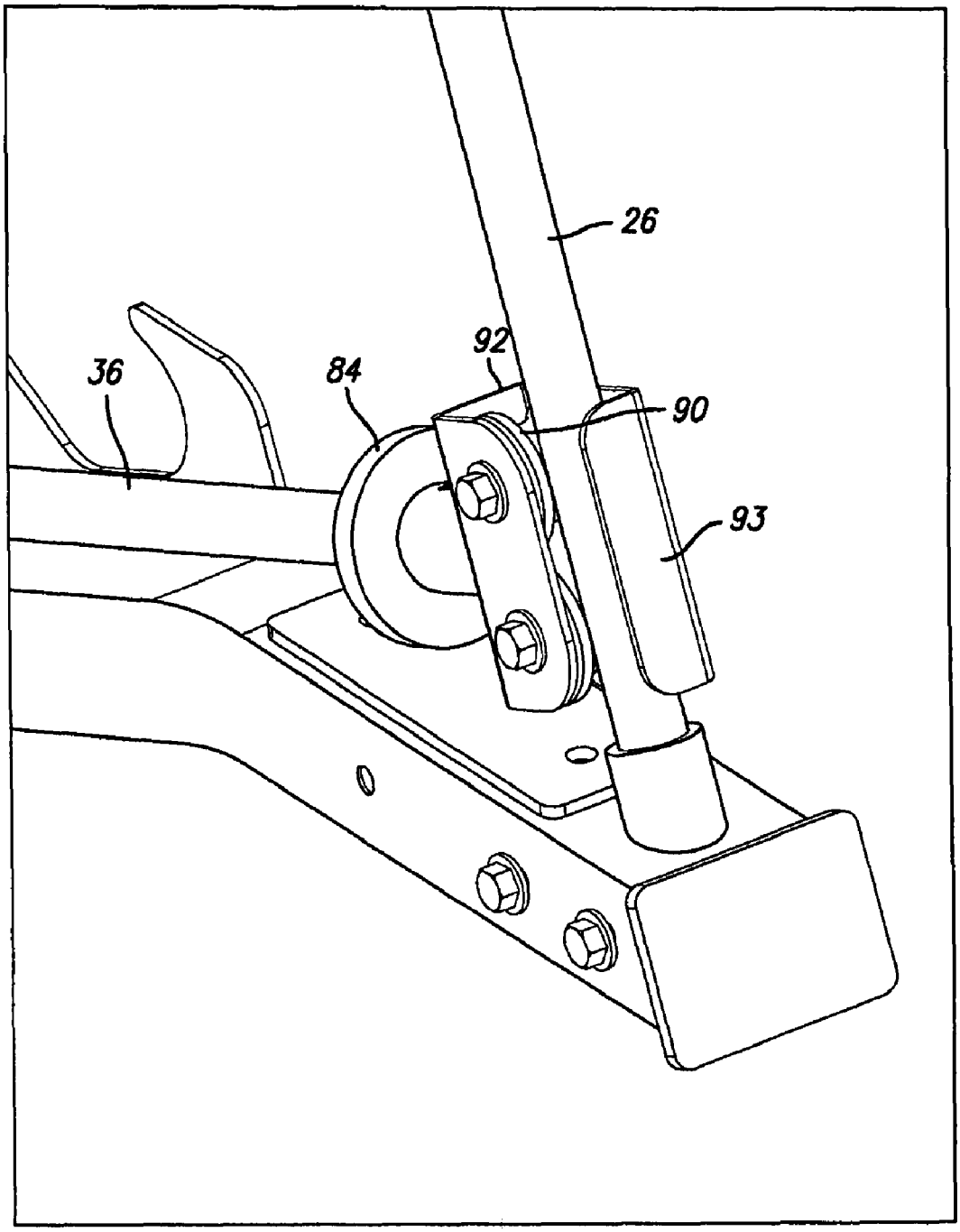
FIG. 14 is a bottom perspective view of the lower horizontal slide of FIGS. 11 to 13.

The horizontal and vertical slides in the machine of FIGS. 1 to 10 are all linear bearings enclosed in outer sleeves which are telescopically engaged over the respective horizontal and linear guides. However, other types of slides or traveling members may be used in alternative embodiments, such as roller wheels. FIGS. 11 to 14 illustrate a modified lower slide comprising a pair of roller wheels 90 mounted in a channel or formed housing 92. The wheels 90 run on top of the horizontal guide 26 with part 93 of the formed housing 92 wrapping around the lower side of the guide 26, as best illustrated in FIGS. 12 and 14, to prevent the slide from coming off the guide. The lower end of the vertical guide 36 engages in a collar 94 projecting upwardly from an upper wall of housing 92, and is rigidly secured to the housing by set screws 95. An end stop bumper 84 is provided on top of collar 94, as in the previous embodiment. Both of the lower slides 40, 42 may be replaced with a modified, roller wheel slide arrangement as illustrated in FIGS. 11 to 14. The other linear bearing slides 45, 48 and 50 may also be replaced with roller wheel slides in a similar manner, if desired.

In each of the embodiments described below and illustrated in FIGS. 15 to 37, the horizontal and vertical slides or traveling members are illustrated as sleeves enclosing linear bearings, as illustrated in FIGS. 1 to 10. However, the roller wheels of FIGS. 11 to 14 may alternatively be used in the first embodiment described above or in any of the following embodiments in place of the linear bearings.

FIGS. 15 to 21 illustrate a second embodiment of a dual action weightlifting exercise machine 100. In this embodiment, there are two upper horizontal guides and two upper horizontal slides attached to the traveling cross bar which extends between the upper ends of the vertical guides. There are also two lower horizontal guides and associated horizontal slides. Unlike the previous embodiment, the respective lower horizontal slides are connected to the vertical guides in an offset manner rather than being positioned directly under the lower ends of the vertical guides, as in FIGS. 1 to 11. Other parts of the machine 100 are identical to those of FIGS. 1 to 11, and like reference numerals have been used for like parts as appropriate.

Figure 15:
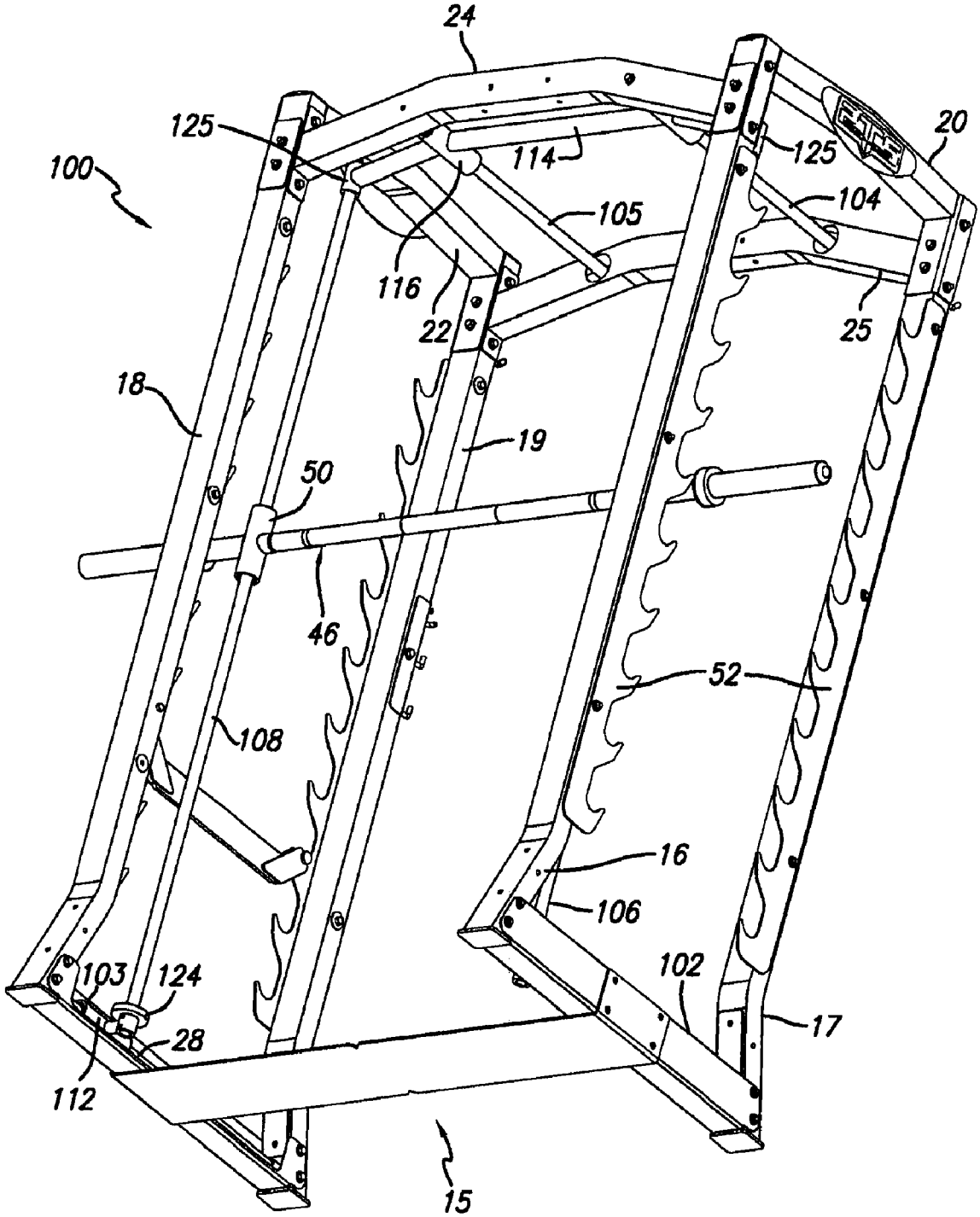
FIG. 15 is a perspective view of a dual action weightlifting machine according to a second embodiment.
Figure 18:
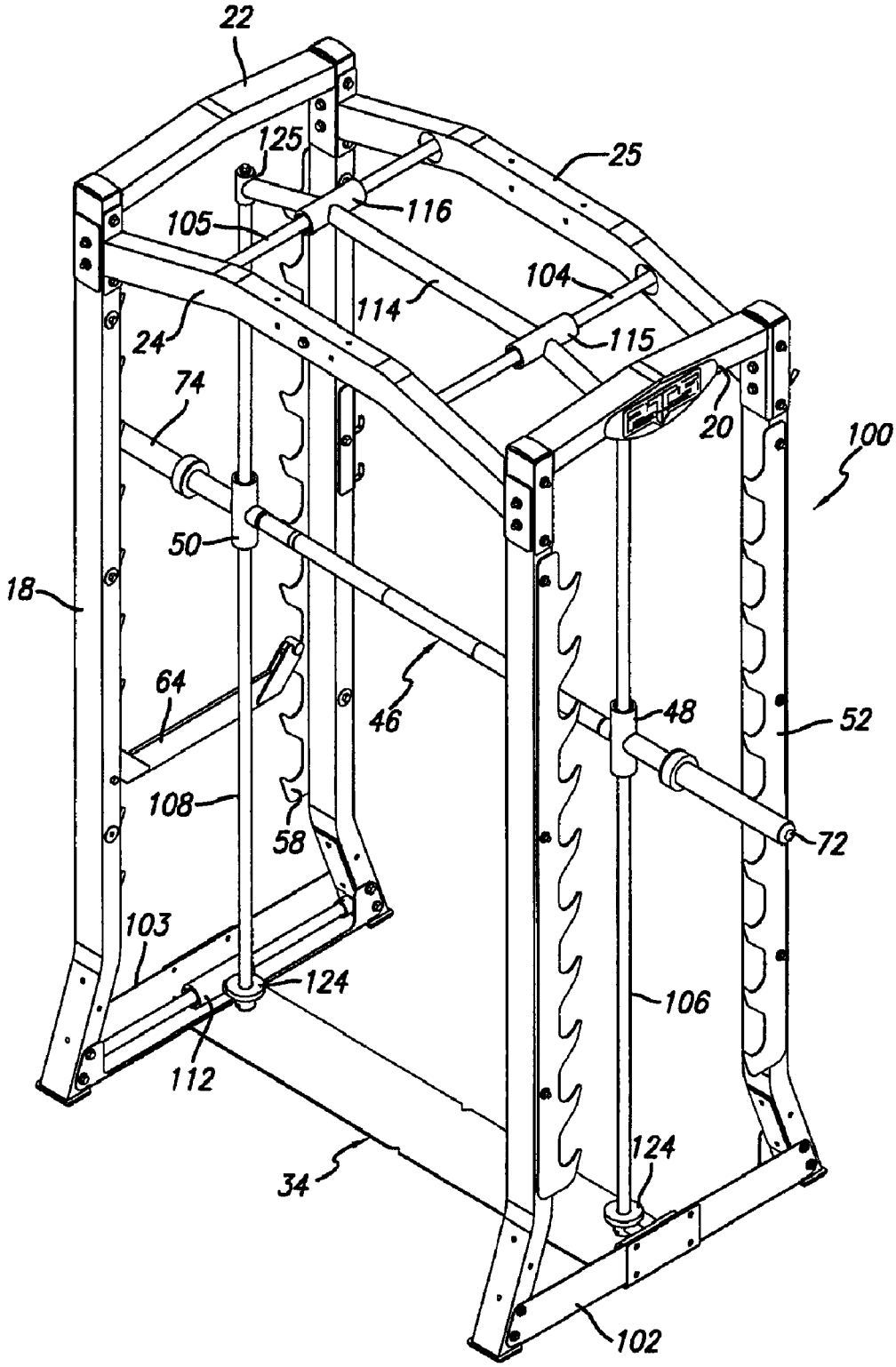
FIG. 18 is a top perspective view of the machine of FIGS. 15 to 17.

The machine 100 basically comprises a stationary main frame and a movable exercise unit which is movably mounted on the frame. As in the first embodiment, the main frame has a floor engaging base 15, first and second pairs of upright struts 16, 17 and 18, 19, respectively, upper struts 20, 22 extending between the upper ends of each pair of upright struts, and upper cross struts 24, 25, the first upper cross strut 24 extending between the upper ends of the front upright strut 16, 18 of each pair, and the second upper cross strut 25 extending between the upper ends of the second upright strut 17, 19 of each pair. A pair of lower horizontal guide bars 26, 28 extends between the lower ends of each pair of cross struts at the lower end of the machine. The guide bars 26, 28 are located in a channel or shield member 102, 103 respectively, forming part of the base of the machine. The shield member is open on its inner side, as seen in FIGS. 15 and 18, to allow for the offset mounting of the vertical guides. Vertical toothed rack plates 52 are mounted on the upright struts in exactly the same manner as the previous embodiment. The single upper horizontal guide bar 44 of the previous embodiment is replaced by two spaced upper horizontal guide bars 104, 105 extending between the upper cross struts 24 and 25.

The movable exercise unit has a pair of vertical guides 106, 108 each slidably mounted at their lower ends on a respective horizontal guide bar 26, 28 via horizontal slides 112, a cross bar 114 extending between the upper ends of the vertical guides and slidably connected to the upper horizontal guide bars 104, 105 via upper horizontal slides 115, 116, and a weight bearing exercise bar 46 extending between the vertical guides and slidably linked to the vertical guides by vertical slides 48, 50. The main difference between this exercise unit and the exercise unit of the previous embodiment is the provision of two horizontal slides 115, 116 on the traveling cross bar 114 engaging the associated offset horizontal guides 104, 105, and the offset mounting arrangement of the vertical guides 106, 108 which are positioned inboard of the respective guide bars 26, 28 rather than directly above the guide bars as in the previous embodiment. The exercise bar 46 is substantially identical to that of the previous embodiment, except that the hook or tooth engaging portions 60, 62 outside the vertical slides 48, 50 are lengthened to allow for the inwardly offset mount of the vertical guides, so that the portions 60, 62 can still engage over the teeth or hooks 58 in the rest position.

Figure 16:
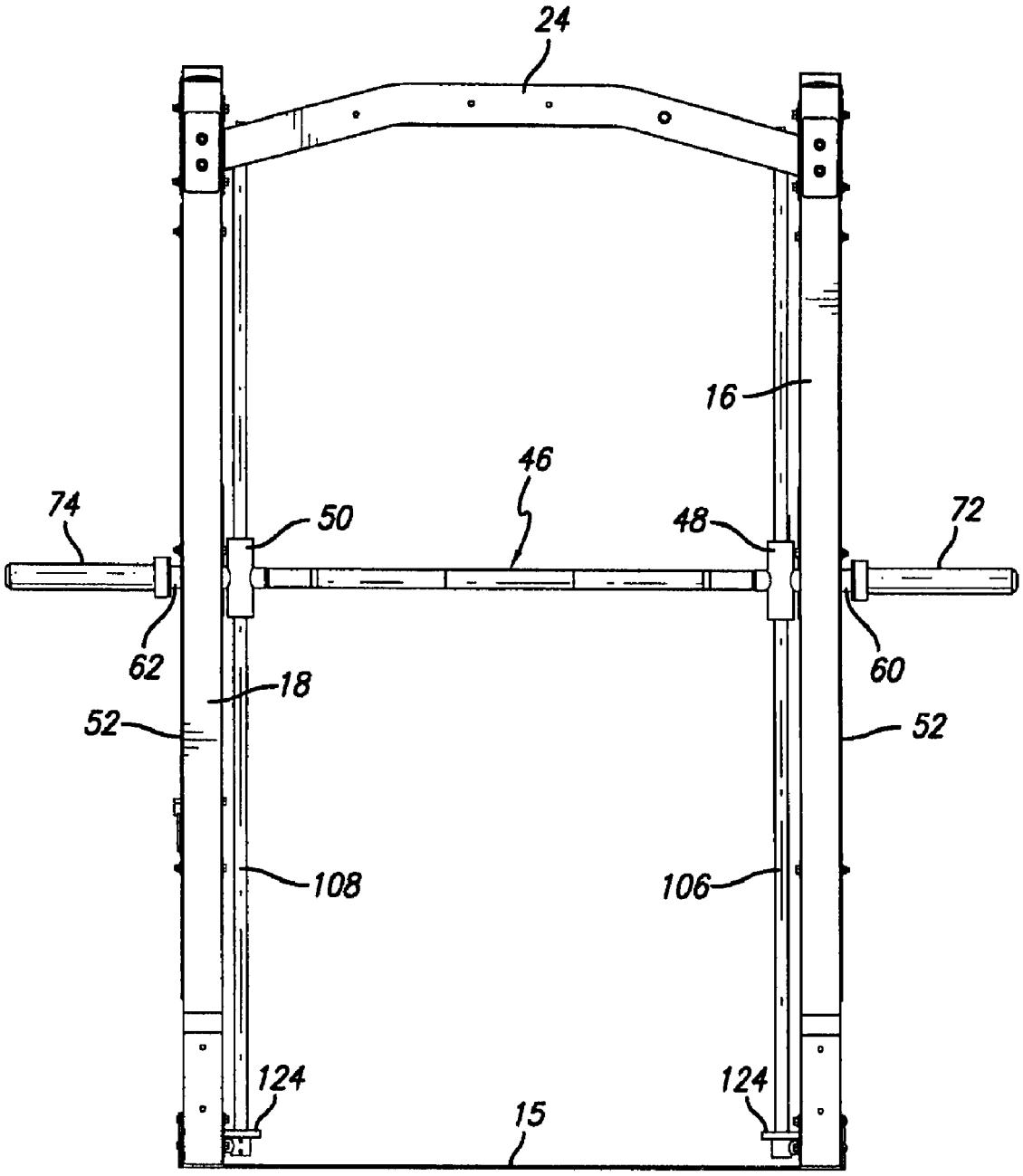
FIG. 16 is a front elevation view of the machine of FIG. 15.
Figure 17:
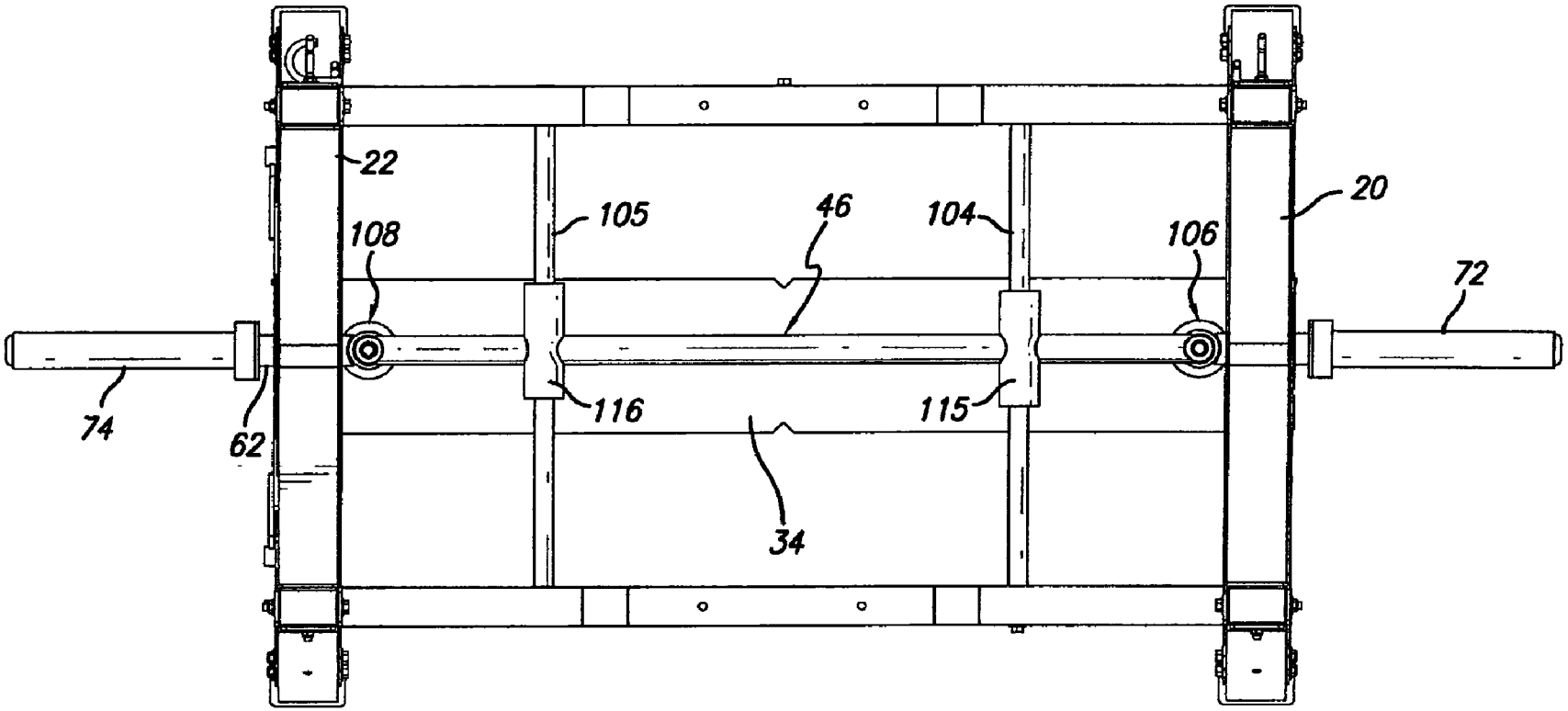
FIG. 17 is a top plan view of the machine of FIGS. 15 and 16.
Figure 20:
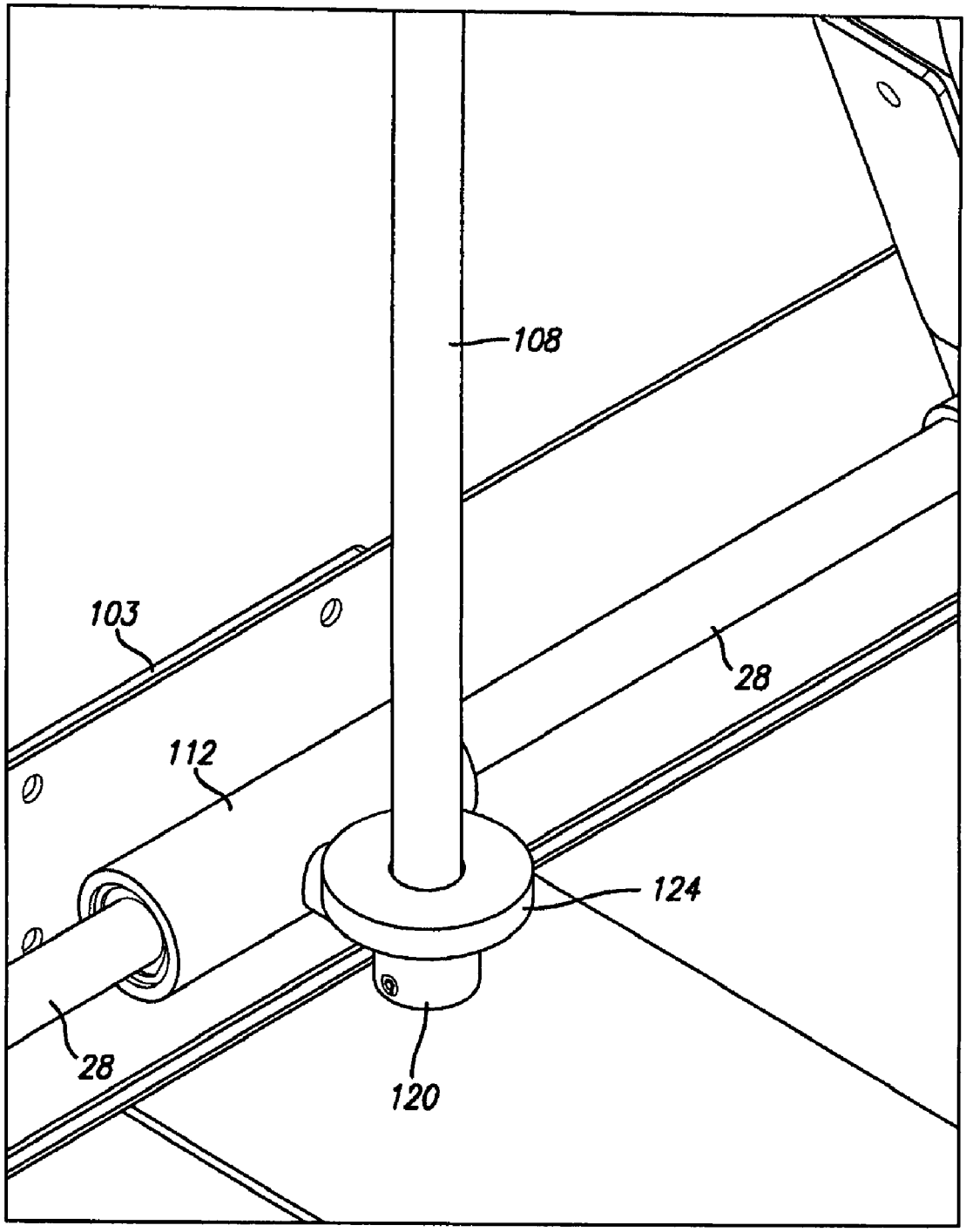
FIG. 20 is an enlarged view of a lower horizontal slide of the machine of FIGS. 15 to 19, showing its rigid, inboard attachment to a vertical guide.
Figure 21:
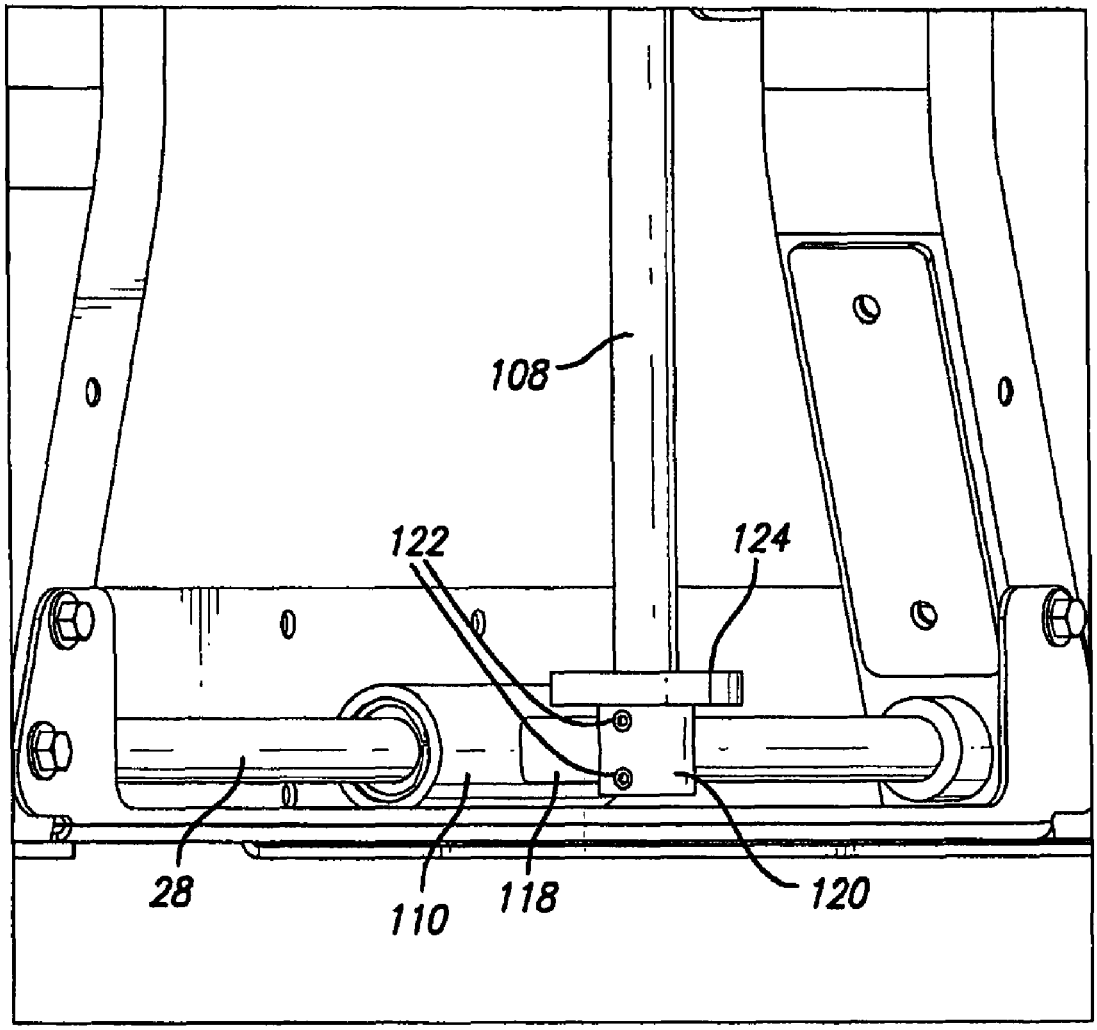
FIG. 21 is a view of the slide of FIG. 20 from a different angle.

The inboard mounting of the vertical guides 106, 108 can be seen in FIGS. 16 to 18 and is illustrated in more detail for one of the vertical guides 108 in FIGS. 20 and 21. The second vertical guide 106 is mounted inboard of the horizontal guide 26 in an identical manner. Each horizontal slide 112 comprises a sleeve housing a linear bearing telescopically engaged over the respective horizontal guide 26, 28, as in the previous embodiment. However, unlike the previous embodiment, the sleeve of slide 112 has an inwardly directed rod 118 on its inner face terminating in an upwardly directed cup or retainer 120 for receiving the lower end of the respective vertical guide 106 or 108, which is rigidly secured to the retainer 120 by set screws 122. As in the previous embodiment, an annular bumper or end stop 124 is provided at the upper end of the cup or retainer 120.

Figure 19:
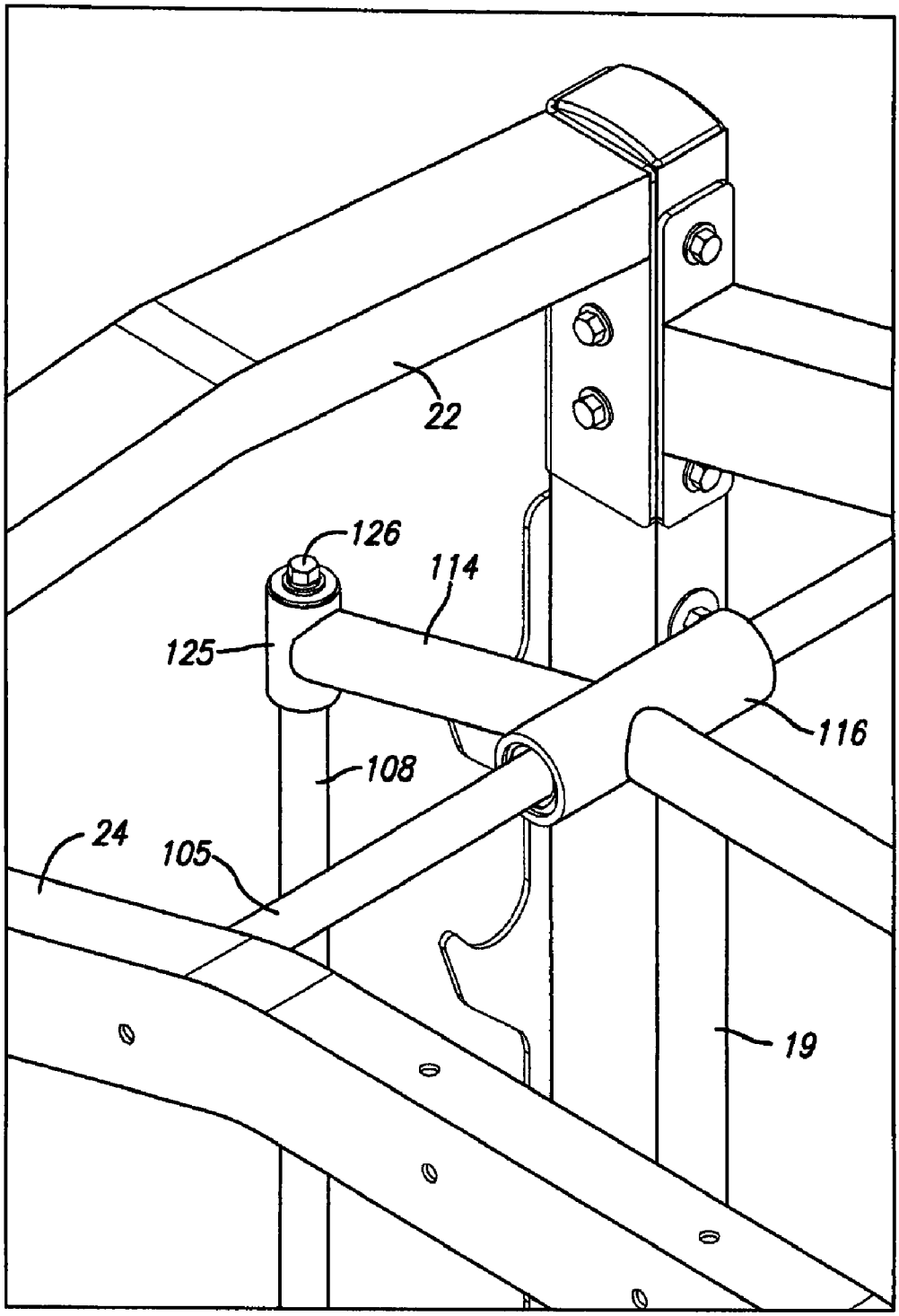
FIG. 19 is an enlarged view of part of the top of the machine of FIGS. 15 to 18 illustrating the attachment of the upper end of one of the vertical guides to the cross bar and one of the slides on the cross bar engaging one of the upper horizontal guide bars.

As in the previous embodiment, the vertical guides 106 and 108 are rigidly attached at their upper ends to the traveling upper cross bar 114. This attachment is illustrated in more detail for one of the vertical guides 108 in FIG. 19, it being understood that the attachment of the opposite end of the cross bar 114 to the other vertical guide 106 is identical. As in the previous embodiment, a cup or mounting ring 125 at each end of the cross bar 114 is engaged over the upper end of the respective vertical guide 106, 108, and is rigidly secured to the vertical guide by a bolt 126. The upper horizontal slides 115, 116 are mounted in line with the cross bar 114 as seen in FIGS. 18 and 19, with each slide comprising an outer sleeve enclosing a linear bearing which is telescopically engaged over the respective upper horizontal guide bar 104, 105.

The inwardly offset mounting of the vertical guides in this embodiment allows the exercise bar 46 to travel lower before it makes contact with the bumper stop 124, which no longer has to be positioned completely above the horizontal slide. In other words, the distance between the connection points of each vertical guide to the respective cross bar 114 or rod 118 which connects the vertical guide to the respective slide is greater than the vertical distance between the upper and lower horizontal slides.

The operation of the weightlifting exercise machine of FIGS. 15 to 21 is substantially identical to that of FIGS. 1 to 11, with the movable exercise unit providing simultaneous horizontal and vertical exercise movement of the weight bearing exercise bar 46. Although there are two lower horizontal guides and two upper horizontal guides in this embodiment, the vertical guides are offset from all of the horizontal guides, and all of the horizontal guides are offset from one another, i.e. none of the horizontal guides are vertically aligned. This offset arrangement gives less play and provides more stability, allowing a smooth exercise movement with reduced risk of jamming or jarring.

Figure 22:
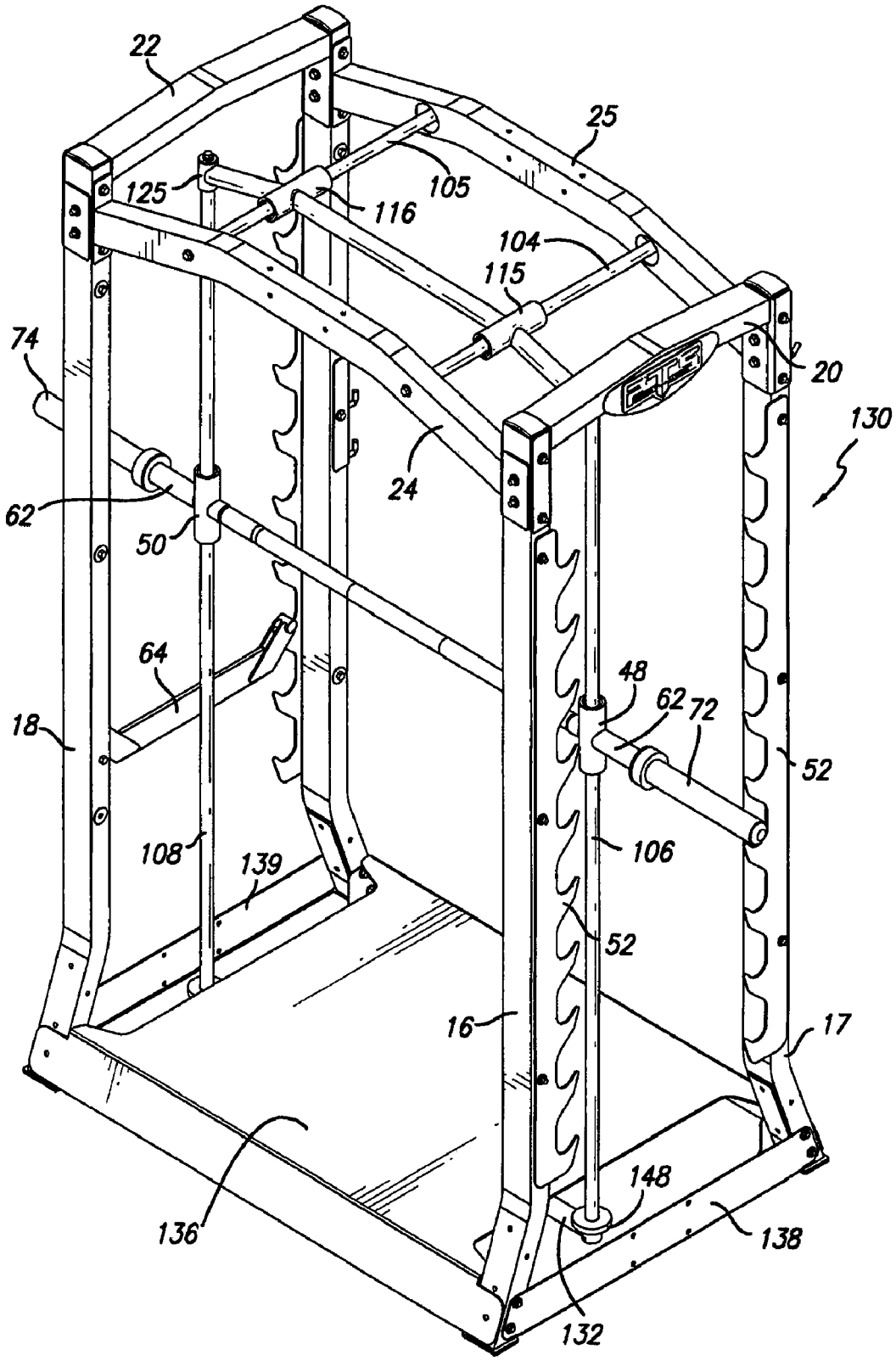
FIG. 22 is a side perspective view of a dual action weightlifting exercise machine according to another embodiment.
Figure 23:
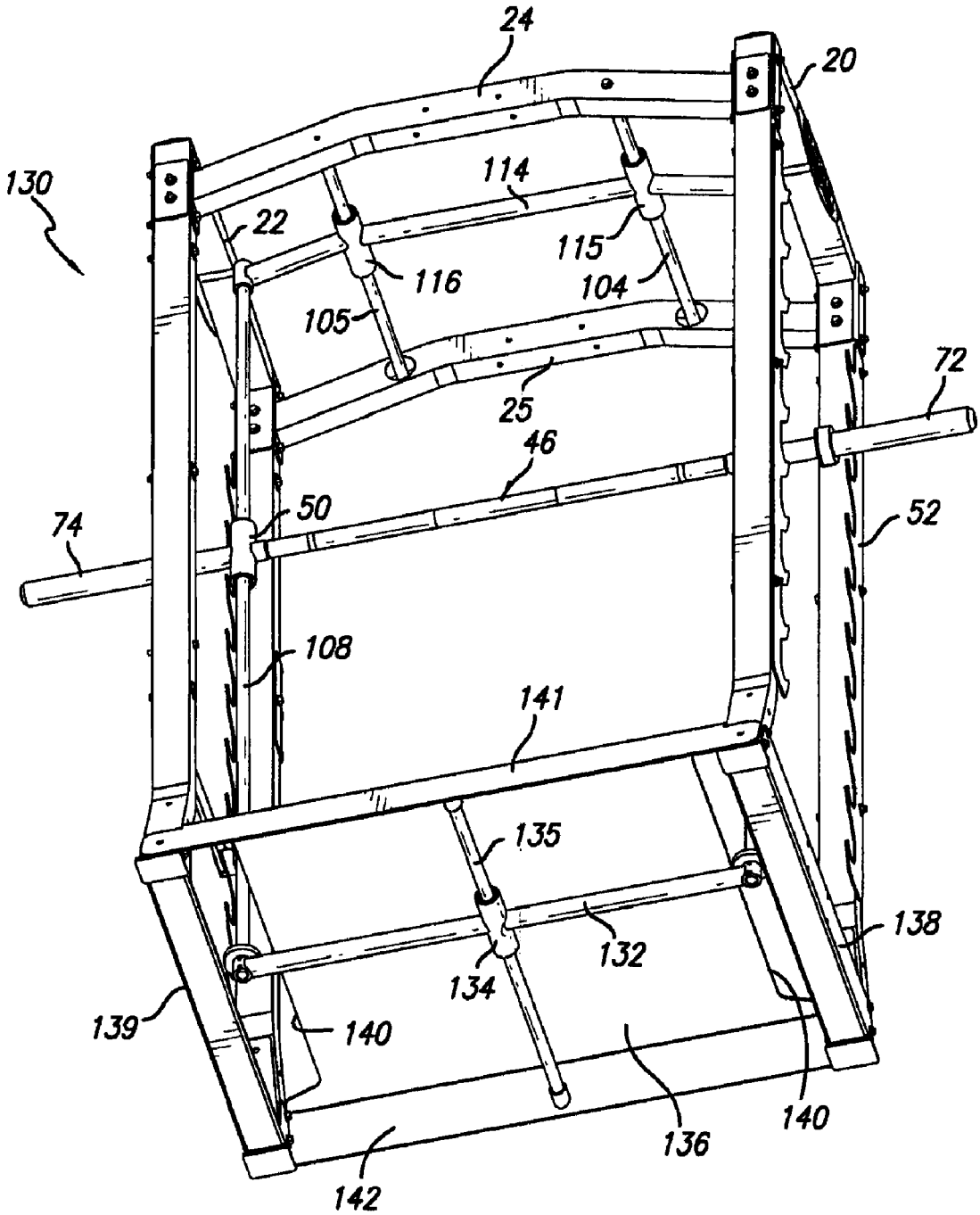
FIG. 23 is a bottom perspective view of the machine of FIG. 22, illustrating the lower traveling cross bar and lower horizontal guide.
Figure 24:
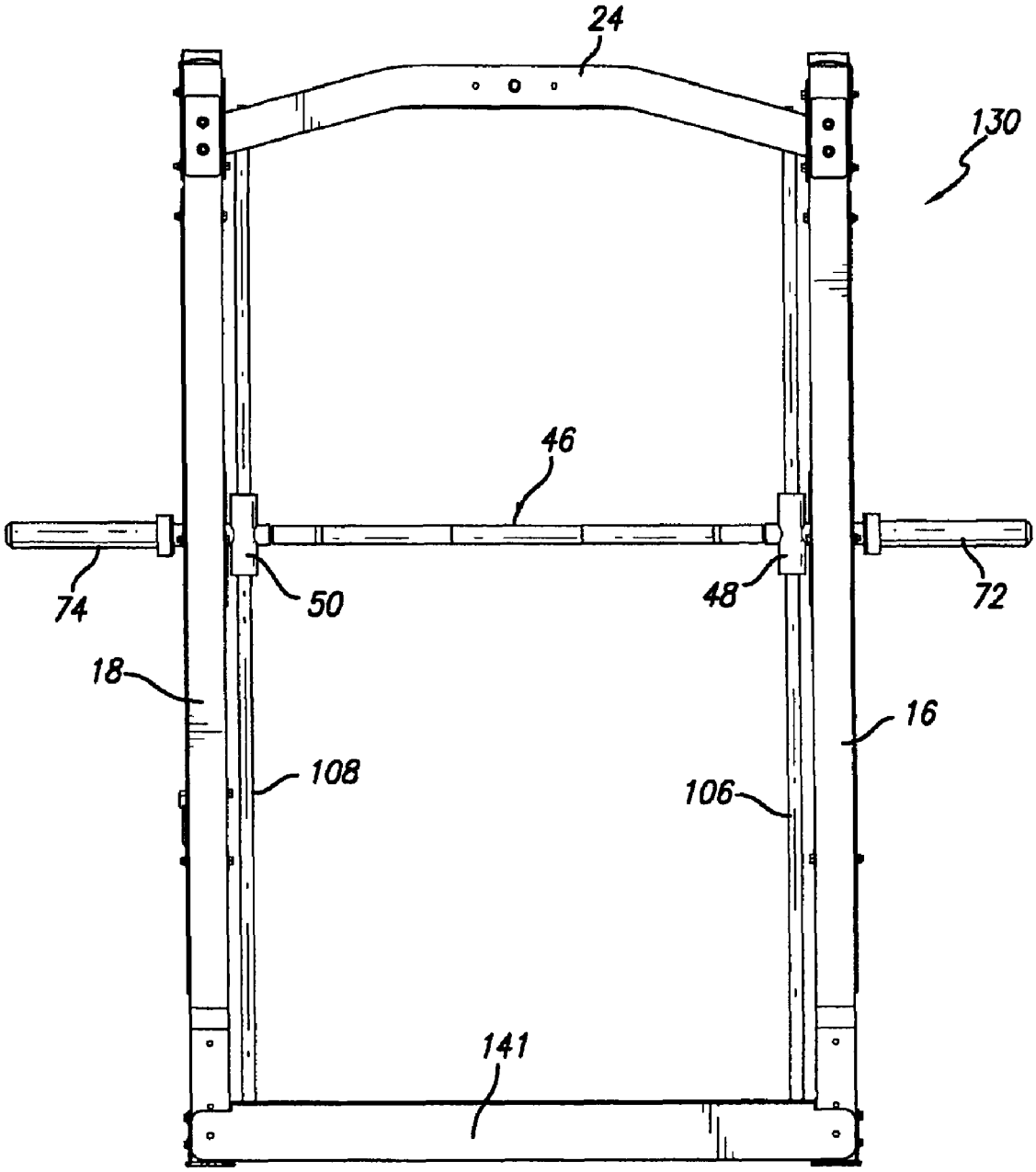
FIG. 24 is a front elevation view of the machine of FIGS. 22 and 23.

FIGS. 22 to 26 illustrate a dual action weightlifting exercise machine 130 according to another embodiment which has an upper traveling cross bar 114 having two horizontal slides 115, 116 engaging two horizontal guides 104, 105, similar to the upper horizontal slide arrangement of the embodiment of FIGS. 11 to 21, and like reference numbers have been used for like parts as appropriate. Unlike the previous embodiments, this embodiment also has a second or lower traveling cross bar between the vertical guides 106, 108, as best illustrated in FIG. 23, the lower horizontal cross bar having a single horizontal slide 134 engaging a single horizontal guide 135 in the base of the machine. The ends of the two traveling cross bars are both rigidly attached to the respective ends of the vertical guides. A platform 136 is mounted on the base of the main frame of the machine, covering the moving lower cross bar and allowing the user to position themselves above the moving lower cross bar and away from any moving parts. This embodiment is otherwise substantially identical to the first embodiment, and like reference numerals have been used for like parts as appropriate.

As in the previous embodiments, the main frame of the machine 130 has first and second pairs of upright struts 16, 17 and 18, 19 each having an attached toothed rack plate 52, upper struts 20, 22 extending between the upper ends of each pair of upright struts, and upper cross struts 24, 25, the first upper cross strut 24 extending between the upper ends of the front upright strut 16, 18 of each pair, and the second upper cross strut 25 extending between the upper ends of the second upright strut 17, 19 of each pair. The upper horizontal guides 104, 105 extend between the upper cross struts 24, 25 at locations offset from the center of the machine and from the opposite sides of the machine. Lower cross plates 138, 139 extend between the lower ends of each pair of upright struts. The platform 136 has cut outs 140 at each side to provide clearance for the lower ends of the vertical guides 106, 108 to extend down for connection to the lower traveling cross bar 132. Alternatively, the traveling cross bar 132 may be bent upwardly at its opposite ends and extend up through the cut outs 140 to connect to the lower ends of the vertical guides. The lower horizontal guide 135 extends between downwardly bent front and rear end portions 141, 142 of the platform 138, as best seen in FIG. 23.

As noted above, in this embodiment the moving exercise unit comprises a pair of vertical guides 106, 108, a first or upper traveling cross bar 114 extending between the upper ends of the vertical guides and associated with two horizontal slides 115, 116 which are slidably engaged with two upper horizontal guides on the main frame, a second or lower traveling cross bar 132 extending between the lower ends of the vertical guides and associated with a single horizontal slide 134 which is slidably engaged with a lower, centrally located horizontal guide 135 in the base of the frame, and an exercise bar 46 which is slidably engaged with the two vertical guides for sliding vertical movement via two vertical slides 48, 50. The exercise bar 46 is identical to the exercise bar of the previous embodiment, with lengthened portions 60 and 62 due to the inwardly offset position of the vertical guides and associated slides 48, 50.

As in the previous embodiment, the vertical and horizontal slides comprise sleeves containing linear bearings telescopically engaged over the respective vertical and horizontal guides. In this embodiment, the vertical guides are mounted outboard from both the upper and the lower horizontal guides, and all three horizontal guides are offset from one another, providing greater stability and less free play when the exercise bar is operated.

Figure 25:
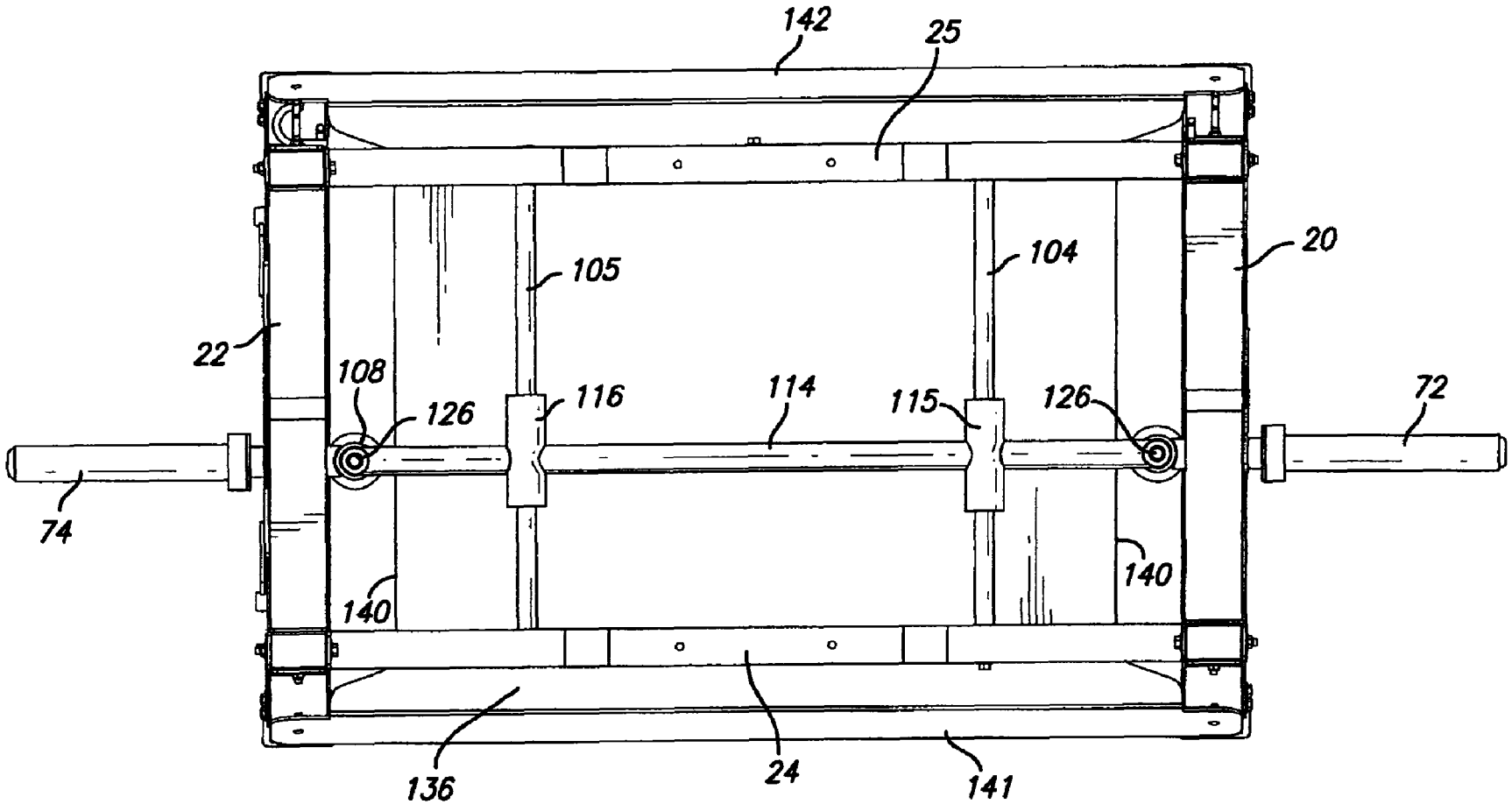
FIG. 25 is a top plan view of the machine of FIGS. 22 to 24.
Figure 26:
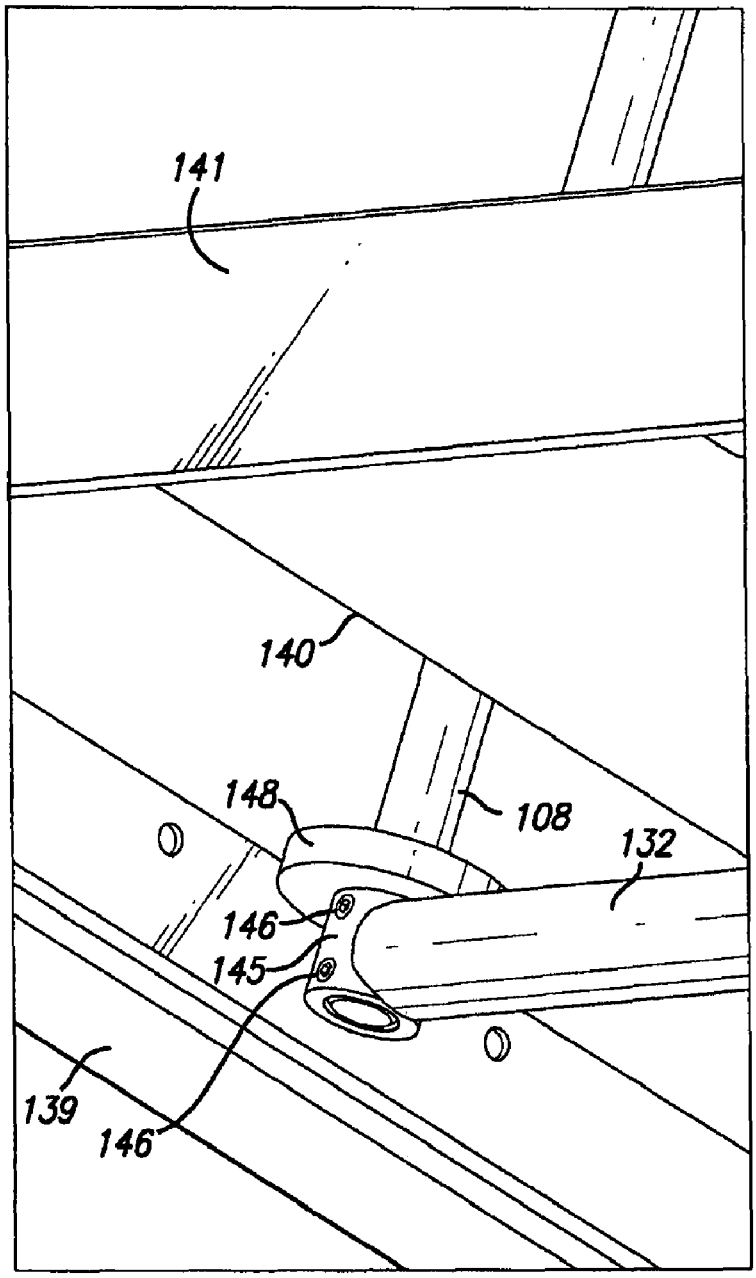
FIG. 26 is an enlarged view illustrating the rigid attachment of the lower cross bar of the machine of FIGS. 22 to 25 to the vertical guide.
Figure 27:
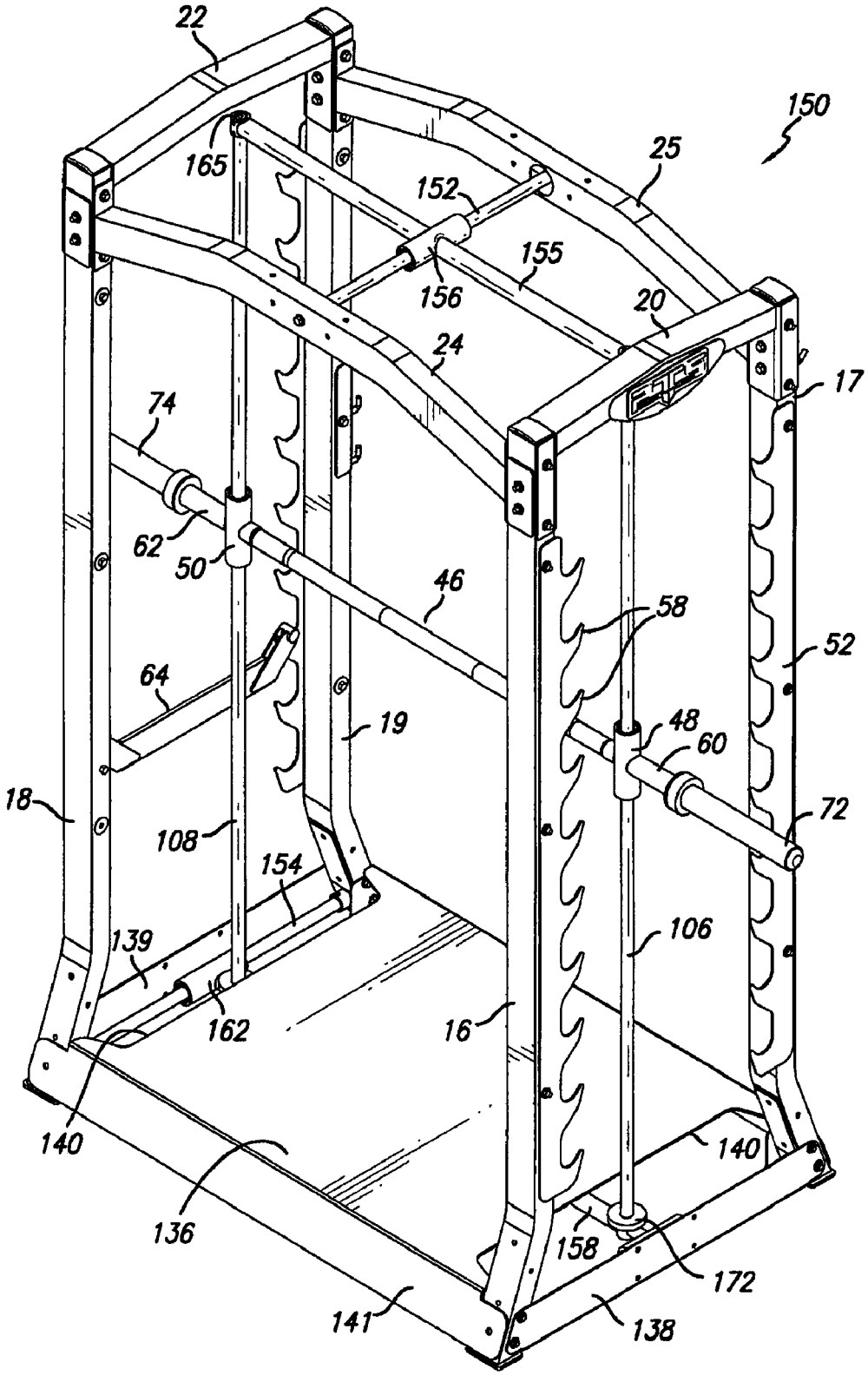
FIG. 27 is a side perspective view of a dual action weightlifting exercise machine according to another embodiment.
Figure 28:
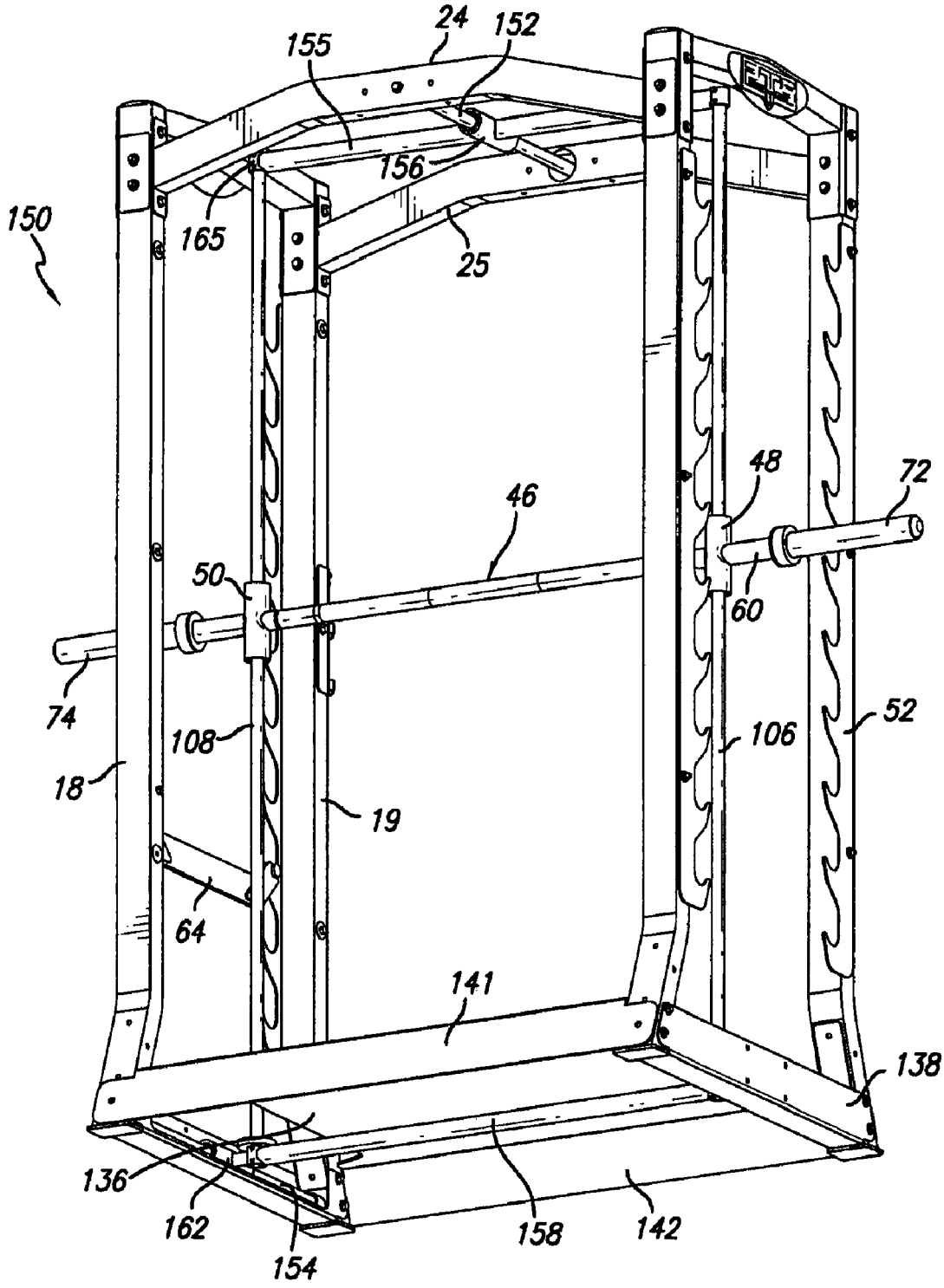
FIG. 28 is a bottom perspective view illustrating the lower cross bar of the machine of FIG. 27.
Figure 29:
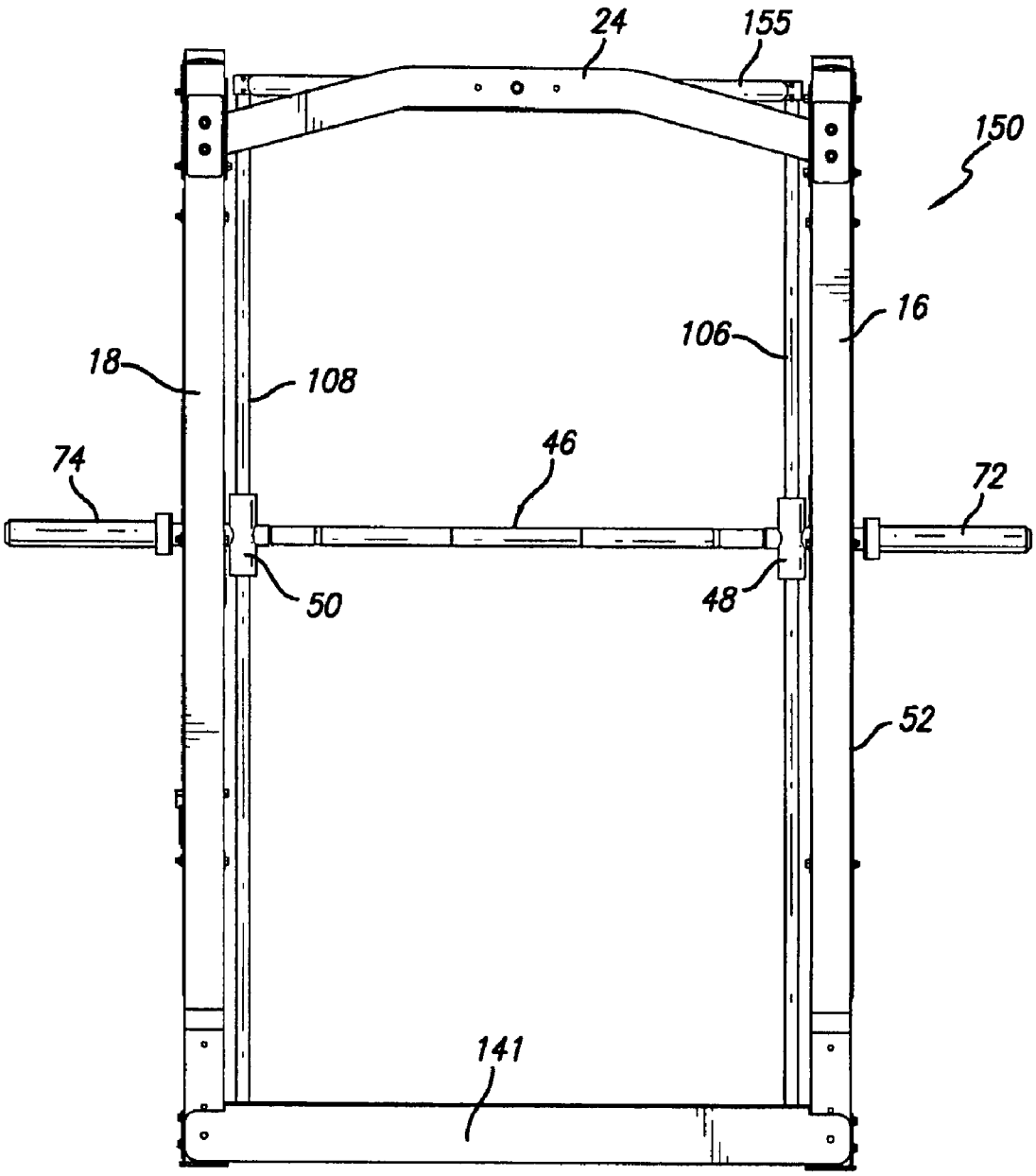
FIG. 29 is a front elevation view of the machine of FIGS. 27 and 28.
Figure 30:
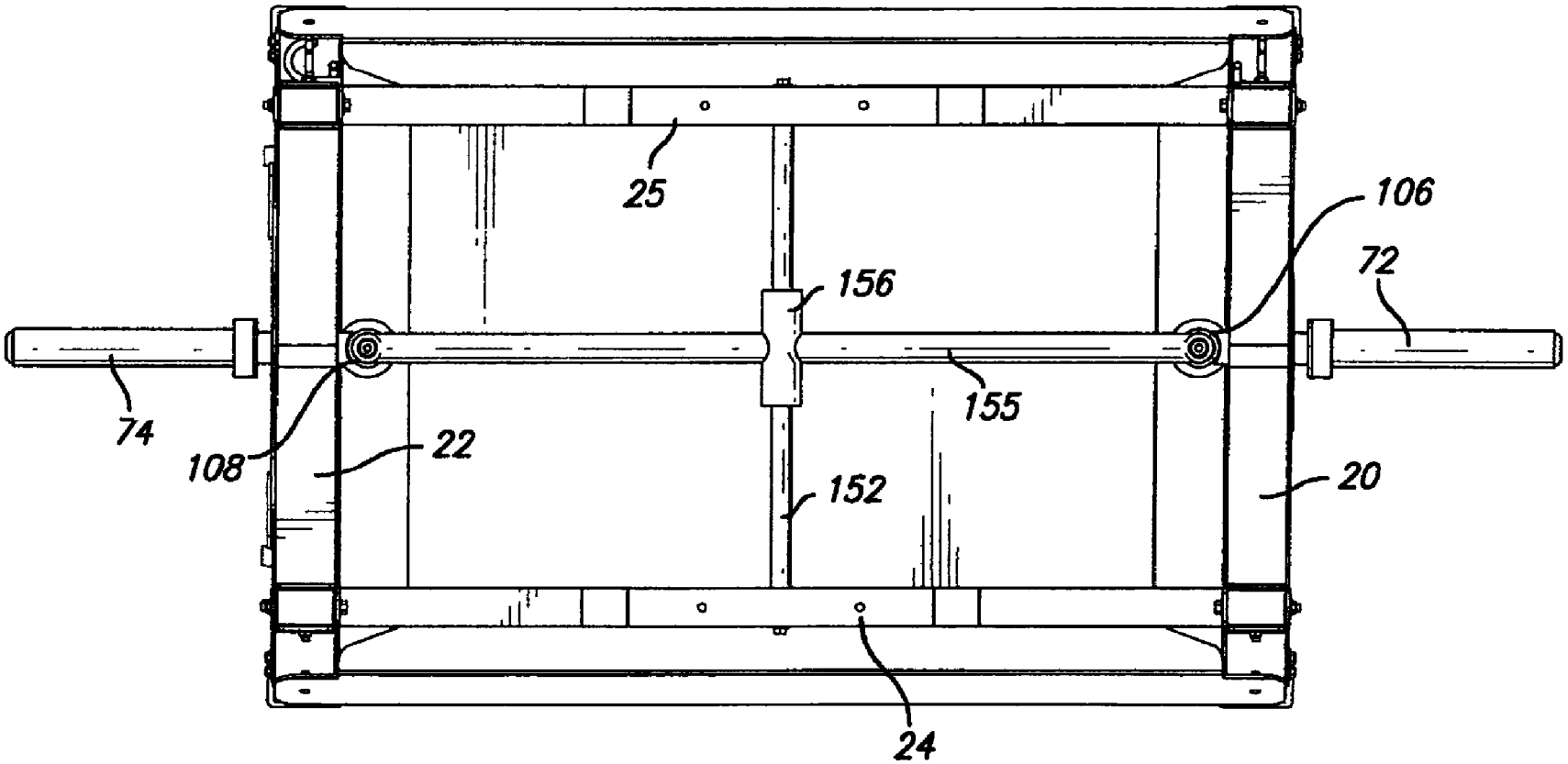
FIG. 30 is a top plan view of the machine of FIGS. 27 to 29.

The upper end of each vertical guide is rigidly attached to the respective end of the upper traveling cross bar 114 via cup 125 and bolt 126, as in the previous embodiment, as illustrated in FIGS. 22 and 25. The attachment of the lower end of the vertical guides to the lower traveling cross bar 132 can be seen in FIGS. 23 and 26. As best seen in FIG. 26, the lower end of vertical guide 108 engages in a vertical mounting sleeve or cup 145 at the end of lower traveling cross bar 132, and is rigidly secured to the sleeve 145 by set screws 146. The lower end of vertical guide 106 is attached to the opposite end of the cross bar 132 in an identical manner. A bumper or end stop 148 is mounted on the lower end of each vertical guide above sleeve 145 to limit downward traveling movement of the exercise bar, as in the previous embodiments. In an alternative arrangement, the ends of the lower cross bar 132 may be bent upwardly and extend through the cut outs, with the lower ends of the vertical guides engaging in the upwardly bent ends of the cross bar and secured in place with set screws.

FIGS. 27 to 32 illustrates a modified exercise machine 150 which is a variation of the embodiment of FIGS. 22 to 26 where the upper cross bar of the moving exercise unit has a single horizontal slide and the lower traveling cross bar has two horizontal slides. The machine is otherwise substantially identical to that of the previous embodiments and like reference numerals have been used for like parts as appropriate.

As in the previous embodiments, the main frame of the machine 150 has first and second pairs of upright struts 16, 17 and 18, 19 each having an attached toothed rack plate 52, upper struts 20, 22 extending between the upper ends of each pair of upright struts, and upper cross struts 24, 25, the first upper cross strut 24 extending between the upper ends of the front upright strut 16, 18 of each pair, and the second upper cross strut 25 extending between the upper ends of the second upright strut 17, 19 of each pair. In this embodiment, a single upper horizontal guide 152 extends between the front and rear cross struts 24, 25 at a central location, similar to the single upper horizontal guide of the first embodiment. Two lower horizontal guide bars 154 (only one of which is visible in the drawings, the other being identical and positioned similarly to the horizontal guide bar 26 of FIG. 1) extend between the lower ends of each pair of upright struts, inboard of the lower shield plates 138, 139 of the frame.

The moving exercise unit in this embodiment is similar to the previous embodiment, since it has a single upper traveling cross bar 155 and a single lower traveling cross bar 158 extending between the upper and lower ends, respectively, of the vertical guides 106 and 108. As in the previous embodiments, exercise bar 46 extends between the vertical guides and is associated with vertical slides 48, 60 which are slidably engaged on the vertical guides 106, 108, respectively. The exercise bar 46 is identical to the exercise bar of the previous embodiments. The upper traveling cross bar 155 has a single horizontal slide 156 slidably engaged on the upper horizontal guide 152. A single lower traveling cross bar 158 is rigidly connected to the lower ends of the vertical guides 106 and 108, and has two lower horizontal slides 162 at its opposite ends which are slidably engaged over the respective lower horizontal guide bars 154. As in the previous embodiments, the horizontal and vertical slides comprise outer sleeves housing linear bearings and are slidably engaged over the respective horizontal and vertical guides, although they may alternatively comprise wheels, rollers, or other sliding devices. A platform 136 is mounted on the base of the main frame of the machine, covering the moving lower cross bar 158 and allowing the user to position themselves above the moving lower cross bar and away from any moving parts. Cut outs 140 in opposite sides of platform 136 provide clearance for the vertical guides 106, 108 to extend past the platform for rigid attachment to the lower traveling cross bar 158, or for a joint to project upwardly from the traveling cross bar through each cut out for rigid attachment to the lower ends of the vertical guides.

Figure 31:
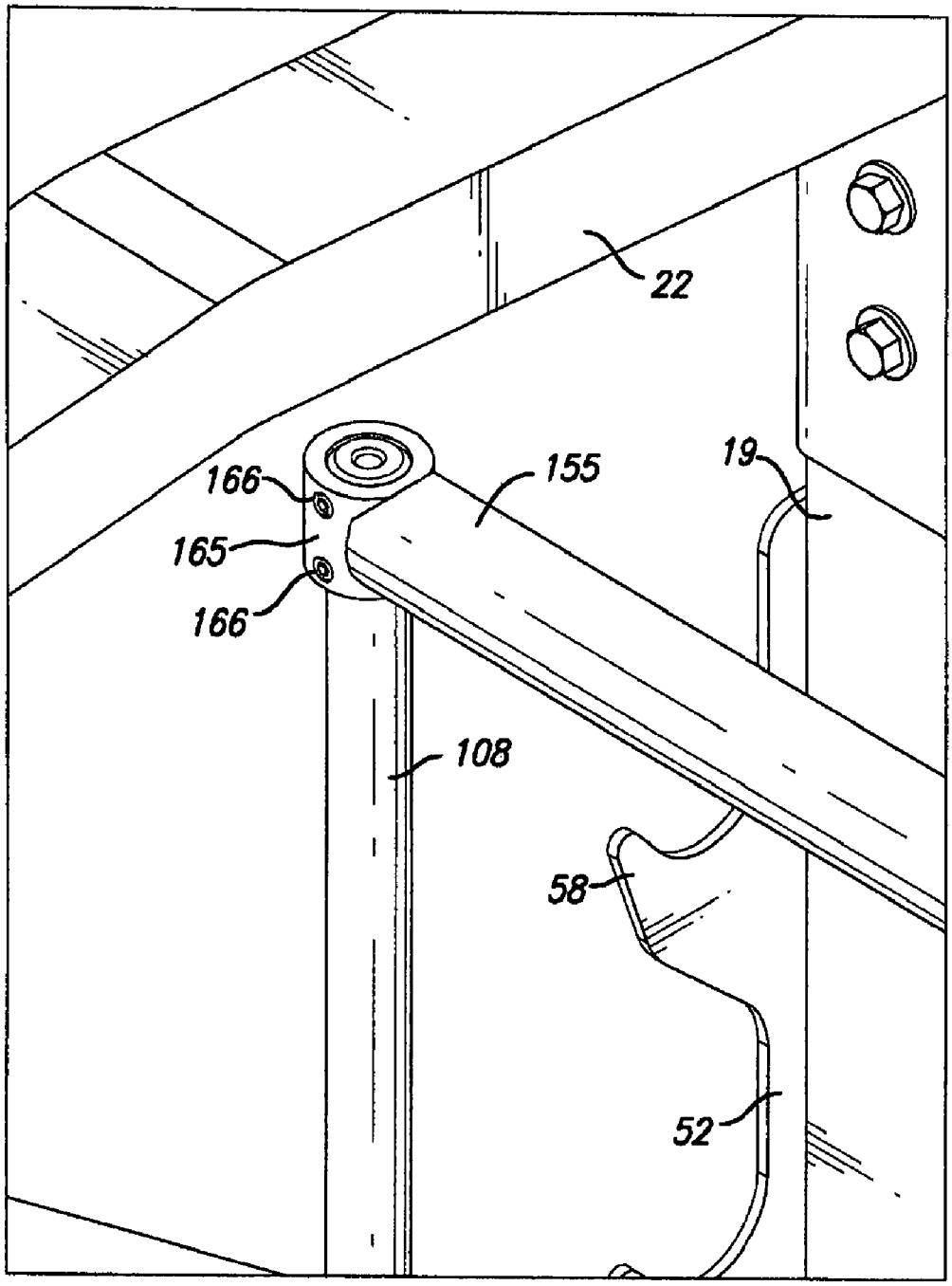
FIG. 31 is an enlarged perspective view of an upper portion of the machine of FIGS. 27 to 30, showing the rigid attachment of the cross bar to the upper end of the vertical guide.

The rigid attachment of the upper traveling cross bar 155 to the upper end of one of the vertical guides 106 is illustrated in more detail in FIG. 31, it being understood that the attachment of the opposite end of the cross bar 155 to the other vertical guide 106 is identical. A vertical mounting sleeve 165 is welded at each end of the traveling cross bar 155. Sleeves 165 are engaged over the upper ends of the respective vertical guides 106, 108 and secured to the guides 106, 108 with set screws 166, as indicated in FIG. 31.

Figure 32:
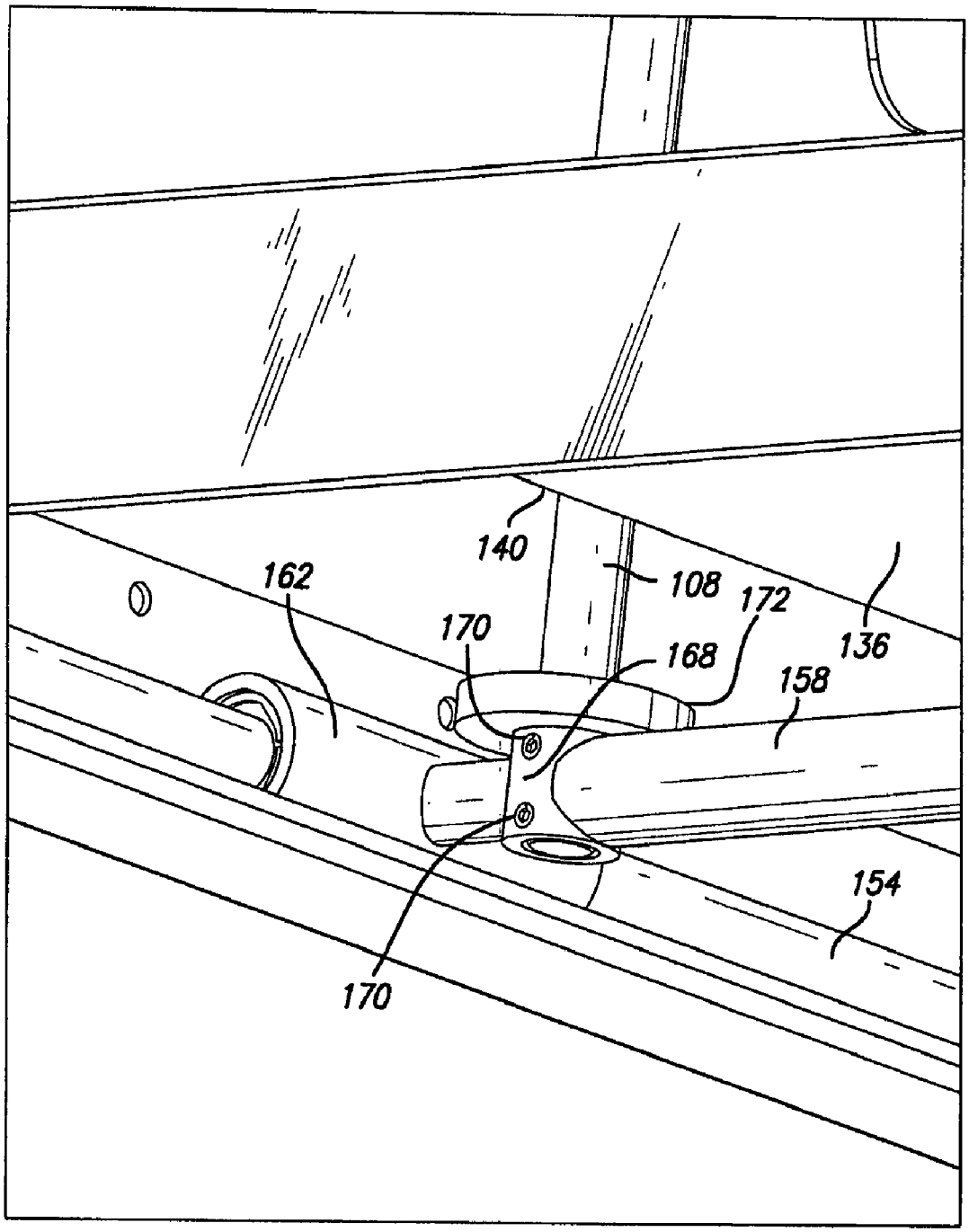
FIG. 32 is an enlarged view illustrating one end of the lower horizontal cross bar of FIG. 28, illustrating the attachment of the cross bar to a slide at one end, outboard of the vertical guide connection point.
Figure 33:
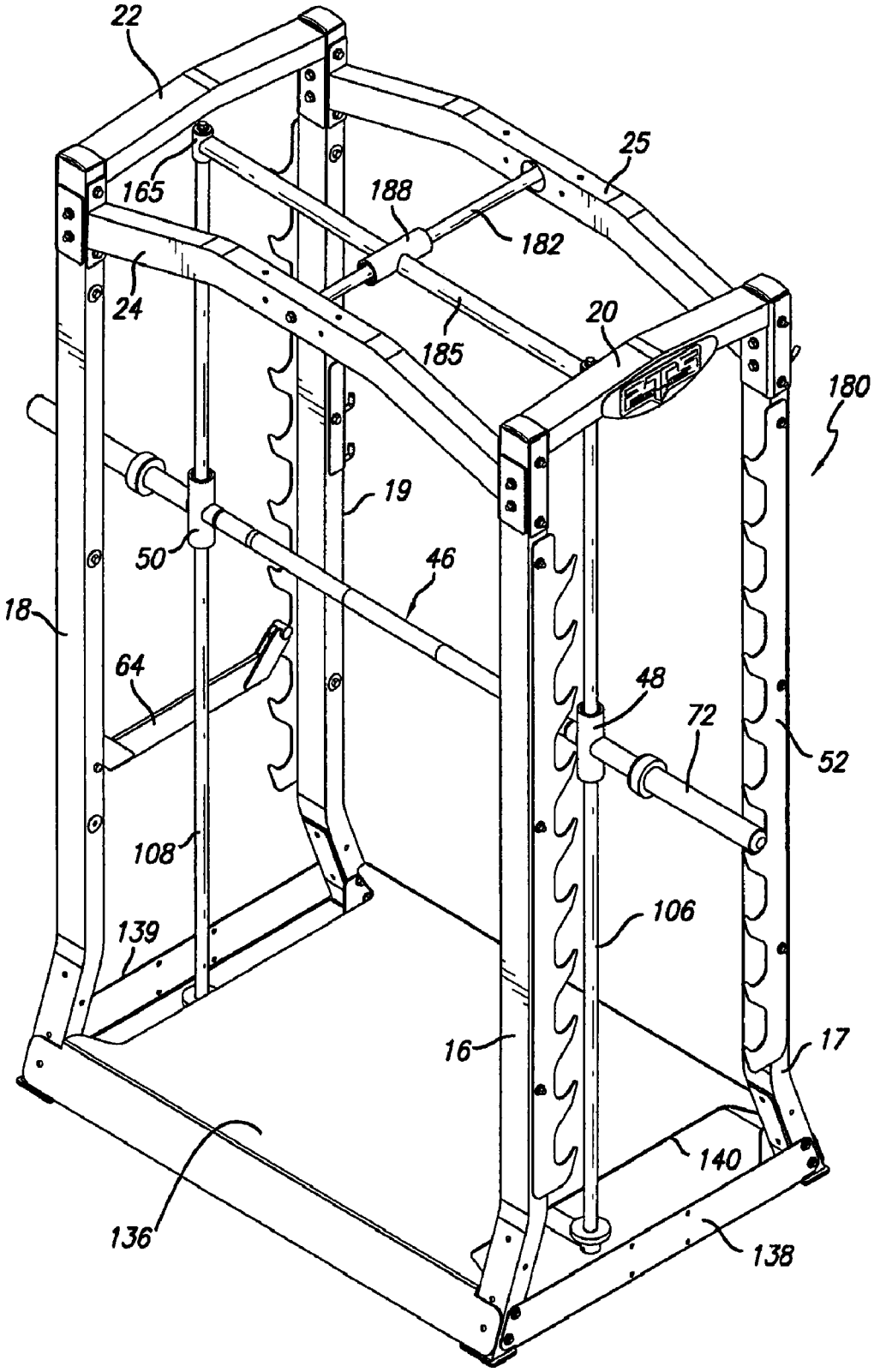
FIG. 33 is a side perspective view of another embodiment of a dual action weightlifting exercise machine.

FIG. 32 illustrates the attachment of the lower traveling cross bar 158 to the lower end of vertical guide 108 and to the horizontal slide 162. The attachment of the lower cross bar 158 to the lower end of vertical guide 106 and to the other lower horizontal slide is identical to that illustrated in FIG. 32. A vertical mounting sleeve 168 is mounted in line with the lower traveling cross bar 158 at a location spaced from the outer end of cross bar 158. The outer end of the cross bar 158 is welded to the inner face of horizontal slide 162. The lower end of the vertical guide 106 engages in vertical mounting sleeve 168 inboard of horizontal slide 162 and is rigidly secured to the sleeve by set screws 170. Thus, in this embodiment, the horizontal slides of the lower traveling cross bar are mounted outboard of the vertical guide connection points, unlike the horizontal slide of the upper traveling cross bar, and unlike the traveling cross bars of all of the previous embodiments which have horizontal slides mounted inboard of the vertical guides. A bumper 172 is mounted on the vertical guide 108 above sleeve 168 for limiting downward movement of the exercise arm.

This embodiment also has a relatively lightweight moving exercise unit with fewer components, making it easier to operate and less expensive. Again, the upper and lower horizontal guides are offset from one another for added stability and reduced free play.

FIGS. 33 to 37 illustrate another modified dual action weightlifting exercise machine 180 for simulating free weight or barbell exercises. The traveling exercise unit of this embodiment has even fewer parts than the previous embodiments, since it has a single upper and lower traveling cross bar, each associated with only one horizontal slide which engages respective upper and lower horizontal guides on the main frame of the machine. The machine is otherwise identical to the previous embodiments, and like reference numerals have been used for like parts as appropriate.

Figure 34:
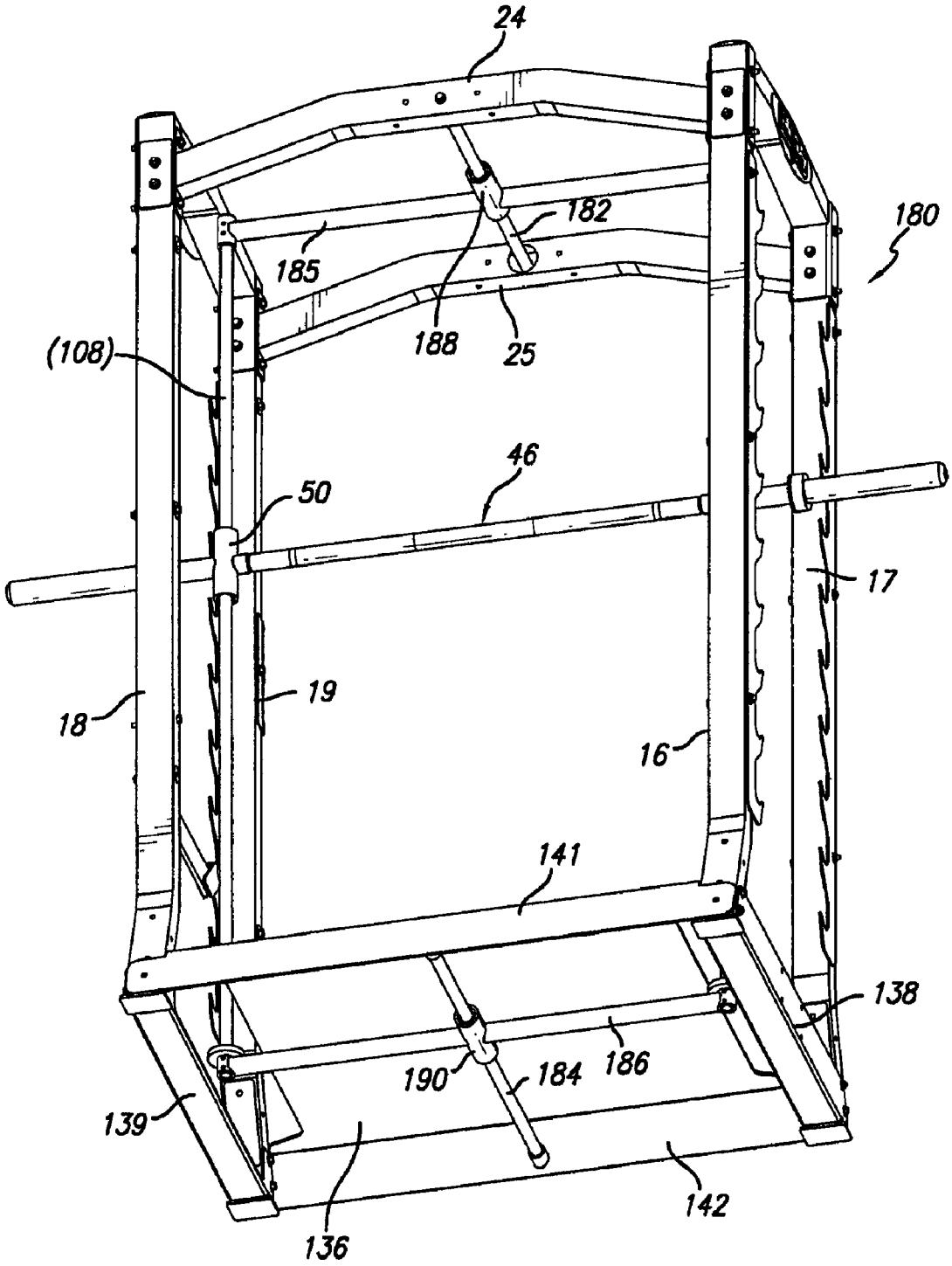
FIG. 34 is a bottom perspective view of the machine of FIG. 33, illustrating the lower horizontal slide and cross bar.
Figure 35:
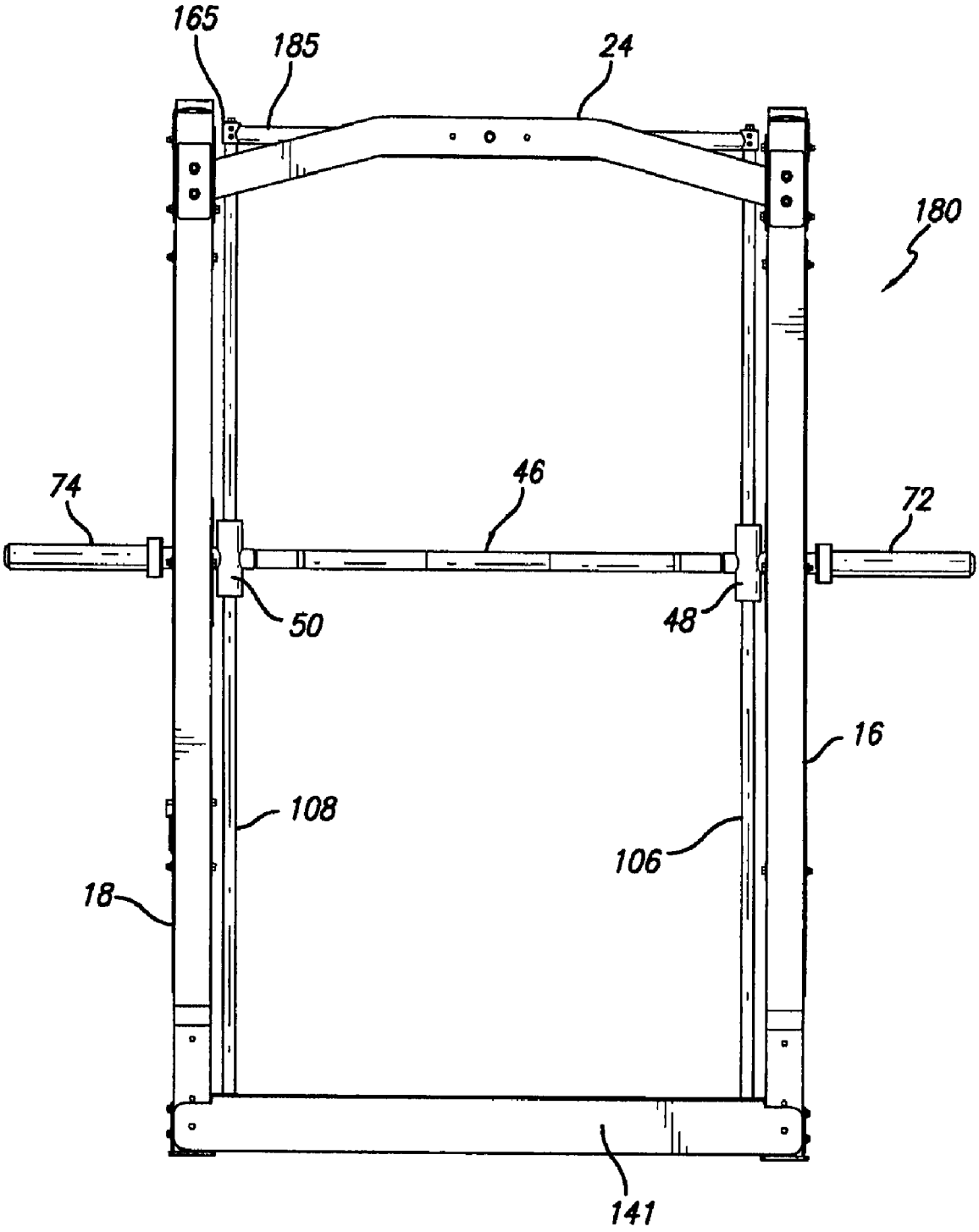
FIG. 35 is a front elevation view of the machine of FIGS. 33 and 34.
Figure 36:
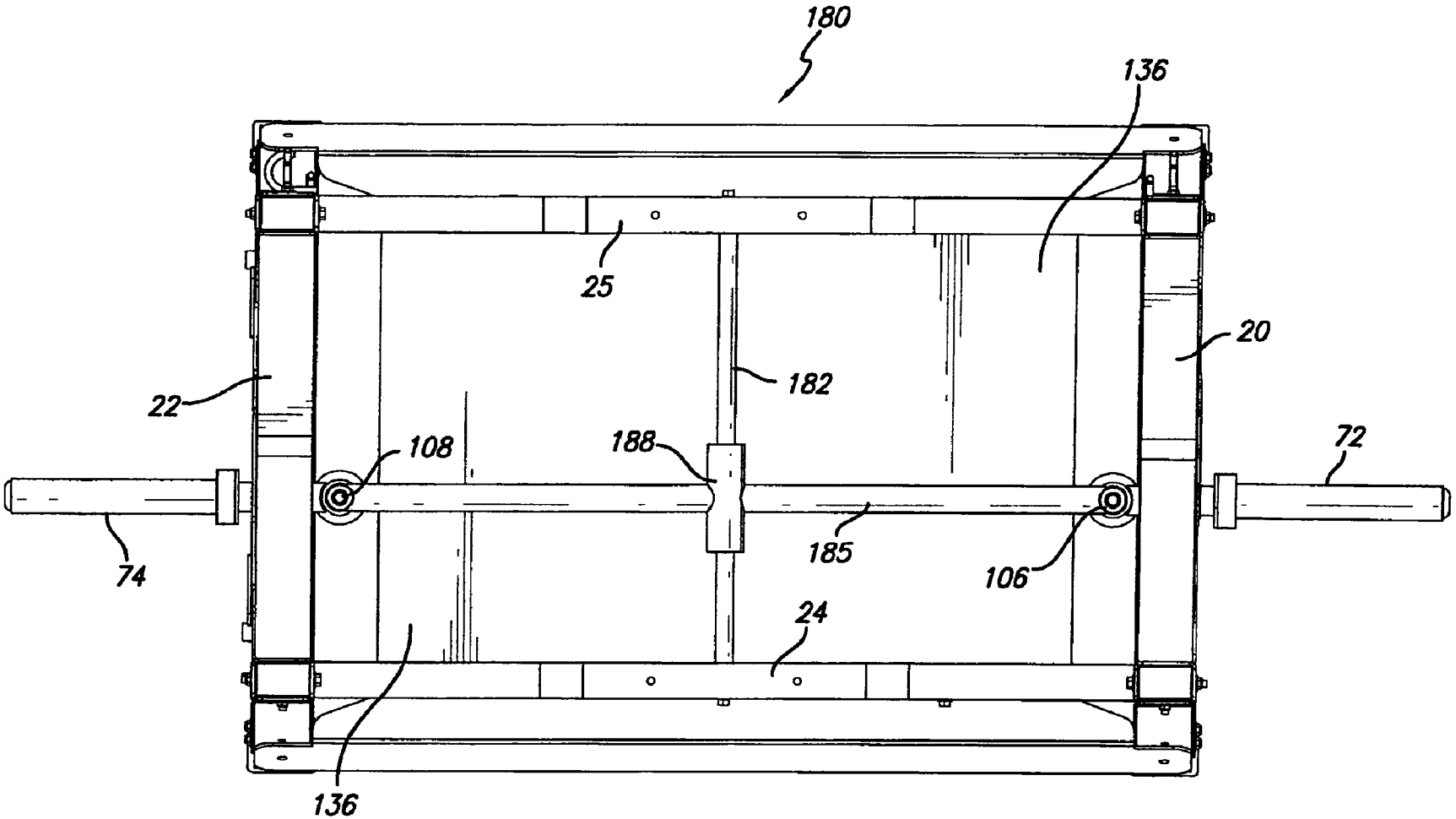
FIG. 36 is a top plan view of the machine of FIGS. 33 to 35.

As in the previous embodiments, the main frame of the machine 180 has first and second pairs of upright struts 16, 17 and 18, 19 each having an attached toothed rack plate 52, upper struts 20, 22 extending between the upper ends of each pair of upright struts, and upper cross struts 24, 25, the first upper cross strut 24 extending between the upper ends of the front upright strut 16, 18 of each pair, and the second upper cross strut 25 extending between the upper ends of the second upright strut 17, 19 of each pair. As in the previous two embodiments, a base platform 136 is mounted on the base of the main frame of the machine, covering the moving lower cross bar and allowing the user to position themselves above the moving lower cross bar and away from any moving parts. A single upper horizontal guide 182 extends between the upper cross struts 24, 25 and a single lower horizontal guide 184 extends between extends between downwardly bent front and rear end portions 141, 142 of the platform 136, as best seen in FIG. 34.

The moving exercise unit in this embodiment is similar to the previous embodiment, since it has a single upper traveling cross bar 185 and a single lower traveling cross bar 186 extending between the upper and lower ends, respectively, of the vertical guides 106 and 108. As in the previous embodiments, exercise bar 46 extends between the vertical guides and is associated with vertical slides 48, 50 which are slidably engaged on the vertical guides 106, 108, respectively. The exercise bar 46 is identical to the exercise bar of the previous embodiments. The upper traveling cross bar 185 has a single horizontal slide 188 slidably engaged on the upper horizontal guide 182. The single lower traveling cross bar 186 has a single horizontal slide 190 slidably engaged on the lower horizontal guide 184, as seen in FIG. 34. Although the upper and lower horizontal guides 182, 184 and associated slides 188, 190 are centrally positioned and in line with one another in the vertical direction in the illustrated embodiment, they may be offset from one another in alternative embodiments. For example, one of the horizontal guides may be offset to the left of the position in FIGS. 33 and 34 and the other horizontal guide may remain in the center or be offset to the right of the position shown in FIGS. 33 and 34.

As in the previous embodiments, the horizontal and vertical slides comprise outer sleeves housing linear bearings and are slidably engaged over the respective horizontal and vertical guides, although they may alternatively comprise wheels, rollers, or other sliding devices. Cut outs 140 in opposite sides of platform 136 provide clearance for the vertical guides 106, 108 to extend past the platform for rigid attachment to the lower traveling cross bar 186 (see FIG. 34). The upper ends of the vertical guides 106 and 108 are rigidly connected to the opposite ends of the horizontal traveling cross bar 185 in exactly the same manner as in the previous embodiment.

Figure 37:
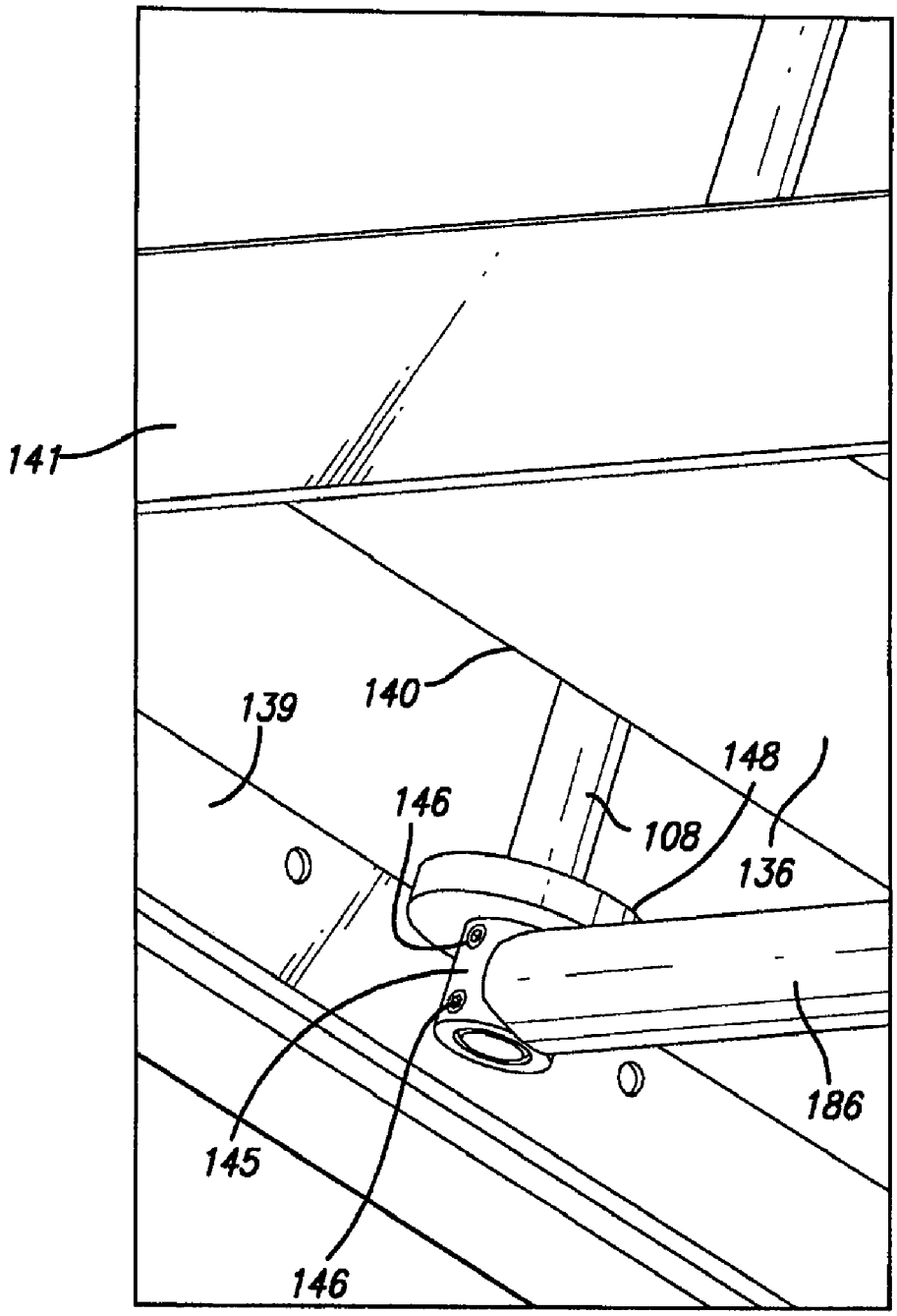
FIG. 37 is an enlarged perspective view of the lower end of the machine of FIGS. 33 to 36, showing the rigid connection between the lower cross bar and one of the vertical guides.

FIG. 37 illustrates the rigid attachment of one end of the lower traveling cross bar 186 to the lower end of one of the vertical guides 108. This is identical to the rigid attachment of the single lower traveling cross bar 132 to the vertical guides in the embodiment of FIGS. 22 to 26, and like reference numerals have been used for like parts as appropriate. Instead of the arrangement shown in FIG. 37 where the vertical guides extend downwardly through cut outs in the base plate or platform 136, the traveling cross bar 186 may have upwardly bent ends which project upwardly through cut outs 140 for attachment to the ends of the vertical guides.

The machine 180 of FIGS. 33 to 37 has a lighter weight moving exercise unit than the previous embodiments since there is only one upper and one lower traveling cross bar and only one horizontal slide associated with each traveling cross bar. However, it may be less stable than the previous embodiments. Offsetting the upper and lower horizontal guides would improve stability. The exercise machine 180 works exactly the same as the machines of the previous embodiments, and allows smooth, simultaneous vertical and horizontal motion of the exercise bar 46.

The weightlifting exercise machines described above have a traveling exercise unit of reduced overall weight and provide a smoother, more fluid exercise motion. Each embodiment has at least one horizontal guide offset from the sides of the frame and one or both horizontal guides may also be offset from the vertical guides. The vertical guides may also be offset from opposite sides of the frame. In a number of these machines, at least one of the horizontal guides is a single horizontal guide bar which is offset from the other horizontal guide or guide bars, and is engaged by a single horizontal slide linked to both vertical guides by a traveling cross bar which is rigidly attached to both vertical guides. This arrangement significantly reduces the number of components required, and thus the overall weight and cost of the exercise machine. It is easier for the novice exerciser to overcome inertia and move the exercise bar when the moving unit is of lighter weight. At the same time, the offset between the upper and lower horizontal guides with which the traveling vertical guides are engaged improve stability and reduce free play, as compared with prior art machines where the upper and lower guides were in line in the vertical direction.

The machines described above require fewer horizontal slides and guides than many prior art designs, and also requires fewer vertical slides and guides than some prior art arrangements. They also requires less traveling framework than some prior designs. Because of the stability and restricted free play, there is no need for any alignment compensation means, as were necessary in some prior art Smith machines.

The exercise bar is also lighter than in prior art machines because of its design as a hollow revolving sleeve. Although some prior art exercise bars do have revolving sleeves, these have limited rotation since they typically have hooks mounted near each end for engaging pinning holes on vertical struts in the rest position. The rotation is therefore limited by a stop mechanism to avoid rotating the hooks into a potentially dangerous position. In contrast, the hollow revolving sleeve of the exercise arm in the above embodiments can rotate freely through 360 degrees. This allows the user to perform exercises such as curls which require different grips on the exercise bar and rotation during the exercise movement.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A dual action weightlifting machine, comprising:

a stationary frame having opposite first and second sides and opposite ends;

first and second spaced vertical guides slidably mounted on the first and second sides, respectively, of the stationary frame for horizontal sliding movement relative to the frame;

a horizontally extending exercise bar assembly having spaced first and second vertical slides slidably mounted on the respective first and second vertical guides for vertical sliding movement relative to the frame, and an exercise bar having a user engaging portion for gripping by a user when performing weightlifting exercises, opposite first and second end portions of a first diameter extending outwardly from the respective first and second sides of the frame for receiving one or more selected weights, a protective sleeve mounted on each end portion, a first annular stop of greater diameter than the first end portion located between the first end portion and the first vertical slide, a second annular stop of greater diameter than the second end portion located between the second end portion and the second vertical slide, the user engaging portion, annular stops and end portions having a common central longitudinal axis, and at least a first rack engaging portion between the user engaging portion and the first annular stop, the rack engaging portion having a cylindrical surface of diameter substantially equal to the first diameter which has a central axis coaxial with the central longitudinal axis of the user engaging portion and weight receiving end portions;

the stationary frame including a rack assembly which has at least one support portion which directly engages the cylindrical surface of the first rack engaging portion at a position spaced transversely outward from the first vertical slide at the first side of the frame and inward from the first annular stop in a racked position of the exercise bar assembly; and the user engaging portion of the exercise bar assembly being rotatably mounted relative to the vertical slides and rack engaging portions and freely rotatable through 360 degrees.

2. The machine of claim 1, wherein the exercise bar extends perpendicular to the vertical guides and has a second rack engaging portion between the user engaging portion and the second annular stop, the first and second weight receiving end portions projecting in a generally outward direction from the first and second annular stops, respectively.

3. The machine of claim 1, wherein the first and second vertical slides comprise first and second sleeves slidably engaged over the respective first and second vertical guides.

4. The machine of claim 1, wherein the exercise bar assembly further comprises first and second mounting portions projecting inwardly relative to the opposite first and second sides of the frame, and the user engaging portion has opposite ends rotatably engaged with the first and second mounting portions, respectively.

5. A dual action weightlifting machine, comprising:

a stationary frame including a racking assembly having a plurality of support portions;

first and second spaced vertical guides slidably mounted on the stationary frame for horizontal sliding movement relative to the frame;

a horizontally extending exercise bar assembly having a user engaging portion for gripping by a user when performing weightlifting exercises, first and second rack engaging portions at opposite ends of the user engaging portion, opposite first and second end portions extending outwardly from the first and second rack engaging portions, respectively, for receiving one or more selected weights, each rack engaging portion having a cylindrical surface of a first diameter configured for direct engagement with a respective support portion of the racking assembly in a racked position of the exercise bar assembly, and spaced first and second vertical slides secured to the exercise bar assembly at positions spaced inward from the first and second rack engaging portion, respectively, and slidably mounted on the first and second vertical guides for vertical sliding movement relative to the frame;

the user engaging portion of the exercise bar assembly which is gripped by a user having a second diameter different from the first diameter, the user engaging portion being rotatably mounted relative to the vertical slides and freely rotatable through 360 degrees, the user engaging portion comprising the only portion of the exercise bar assembly which rotates, whereby the user's hands may be rotated relative to the vertical slides during a weight lifting exercise; and the user engaging portion, rack engaging portions, and end portions of the exercise bar assembly being coaxially aligned and having a common central longitudinal axis which extends transverse to the vertical slides.

6. The machine as claimed in claim 5, wherein the frame has opposite ends and first and second spaced upright struts at least at one end of the frame, the upright struts having a plurality of spaced support portions, the support portions of the first upright strut facing the first rack engaging portion and the support portions of the second upright strut facing the second rack engaging portion, the exercise bar assembly being movable between exercise positions spaced from the upright struts and at least one racking position, the cylindrical surface of the first rack engaging portion directly engaging a selected support portion on the first upright strut and the cylindrical surface of the second rack engaging portion directly engaging an aligned support portion on the second upright strut in the racking position.

7. The machine as claimed in claim 6, wherein the support portions of the upright struts extend towards the exercise bar assembly and are oriented perpendicular to the central longitudinal axis of the user engaging portion of the exercise bar assembly.

8. The machine as claimed in claim 7, wherein the support portions on the upright struts comprise upwardly facing hooks.

9. The machine as claimed in claim 8, wherein the user engaging portion and weight receiving end portions of the exercise bar assembly arc coaxial with the central axes of the upwardly facing hooks in which the cylindrical surfaces of first and second rack engaging portions are engaged in the racking position.

10. A dual action weightlifting machine, comprising:

a stationary frame including a racking assembly having a plurality of support portions, the frame having opposite sides defining an exercise area between the opposite sides of the frame;

first and second spaced vertical guides slidably mounted on opposite sides of the stationary frame for horizontal sliding movement relative to the frame, each vertical guide having a central vertical axis;

a horizontally extending exercise bar assembly having spaced first and second vertical slides slidably mounted on the vertical guides for vertical sliding movement relative to the frame, a user engaging portion in the exercise area for gripping by a user when performing weightlifting exercises, at least one rack engaging portion having a cylindrical surface which directly engages a selected support portion of the racking assembly in a racked position of the exercise bar assembly, and opposite first and second end portions for receiving one or more selected weights;

the user engaging portion having a smaller diameter than the rack engaging portion and end portions, and being located between the vertical slides and not extending outwardly beyond the vertical slides, and having a central longitudinal axis which is aligned and coaxial with the cylindrical surface of said rack engaging portion and perpendicular to the vertical axis of each vertical guide; and the user engaging portion being rotatably mounted relative to the vertical slides and rack engaging portions of the exercise bar assembly, and being freely rotatable through 360 degrees, whereby the user's hands may be rotated relative to the vertical slides during a weight lifting exercise.

11. The machine as claimed in claim 10, wherein the cylindrical surface of said rack engaging portion is spaced outward from the user engaging portion in a direction along said central longitudinal axis.

12. The machine as claimed in claim 10, wherein the cylindrical surfaces of the rack engaging portions have a first diameter and the user engaging portion has a second diameter which is different from the first diameter.

13. A dual action weightlifting machine, comprising:

a stationary frame including a racking assembly having a plurality of support portions;

first and second spaced vertical guides slidably mounted on the stationary frame for horizontal sliding movement relative to the frame, each vertical guide having a central vertical axis;

a horizontally extending exercise bar assembly having spaced first and second vertical slides slidably mounted on the vertical guides for vertical sliding movement relative to the frame, a user engaging portion for gripping by a user when performing weightlifting exercises, at least one rack engaging portion which directly engages a selected support portion of the rack assembly in a racked position of the exercise bar assembly, and opposite first and second end portions for receiving one or more selected weights;

the user engaging portion located between the vertical slides and not extending outwardly beyond the vertical slides, and having a central longitudinal axis which is coplanar with the vertical axis of each vertical guide; and the user engaging portion being rotatably mounted relative to the vertical slides and freely rotatable through 360 degrees, whereby the user's hands may be rotated relative to the vertical slides during a weight lifting exercise.

14. The machine of claim 13, wherein the first and second vertical slides comprise first and second sleeves slidably engaged over the respective first and second vertical guides.

15. The machine of claim 14, wherein each sleeve has a mounting portion projecting radially inwardly from the sleeve in alignment with the mounting portion on the other sleeve, and the user engaging portion is rotatably mounted on the mounting portions.

16. The machine of claim 13, wherein the exercise bar assembly further comprises a bar extending transversely between the sleeves and the user engaging portion comprises at least one hand grip sleeve rotatably mounted on the bar.

17. The machine of claim 16, wherein the user engaging portion comprises a pair of hand grip sleeves rotatably mounted on the bar.

18. The machine of claim 13, wherein the first weight engaging end portion projects outward from the first sleeve and the second weight engaging end portion projects outward from the second sleeve.

19. A dual action weightlifting machine, comprising:

a stationary frame having opposite first and second ends and opposite first and second sides, first and second spaced upright struts at the first end of the frame, each upright strut having a plurality of vertically spaced, upwardly directed support portions, the support portions of the upright struts defining a plurality of spaced racking positions;

first and second spaced vertical guides slidably mounted on opposite sides of the stationary frame for horizontal sliding movement relative to the frame;

the first vertical guide being spaced inwardly from the support portions on the first upright strut, and the second vertical guide being spaced inwardly from the support portions on the second upright strut;

a horizontally extending exercise bar assembly having spaced first and second vertical slides slidably mounted on the vertical guides for vertical sliding movement relative to the frame, a user engaging portion rotatably mounted relative to the vertical slides, opposite first and second end portions for receiving one or more selected weights, each end portion having an outer sleeve, first and second annular stops of larger diameter than the first and second end portions, the first annular stop located between the first end portion and first vertical slide and the second annular stop located between the second end portion and second vertical slide, and spaced first and second rack engaging portions each having a cylindrical surface of substantially the same diameter as the first and second end portions which directly engages the support portions in a respective upright strut in the racking positions, the first rack engaging portion located between the first annular stop and the first vertical slide and the second rack engaging portion located between the second annular stop and the second vertical slide;

the user engaging portion of the exercise bar assembly having a central longitudinal axis which extends transverse to the vertical slides, and the end portions and cylindrical rack engaging surfaces of the rack engaging portions having central axes which are coaxial with the central longitudinal axis of the user engaging portion;

the exercise bar assembly being movable between exercise positions spaced from the upright struts and racking positions in which the cylindrical surfaces of the first and second rack engaging portions directly engage the support portions of the respective upright struts to support the exercise bar assembly on the struts; and the user engaging portion being freely rotatable through 360 degrees in the exercise position and the racking positions, whereby the user's hands may be freely rotated relative to the vertical slides.

* * * * *